US010815712B2

(12) United States Patent
Toloday et al.

(10) Patent No.: US 10,815,712 B2
(45) Date of Patent: Oct. 27, 2020

(54) DOOR CLOSER APPARATUS AND METHOD

(71) Applicant: Schlage Lock Company LLC, Carmel, IN (US)

(72) Inventors: David V. Toloday, Martinsville, IN (US); Robert Prostko, Carmel, IN (US); Matthew Dexter, Indianapolis, IN (US); Christopher M. Salisbury, Ohio, IL (US); Adithya G. Shetty, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 16/284,691

(22) Filed: Feb. 25, 2019

(65) Prior Publication Data

US 2019/0264486 A1 Aug. 29, 2019

Related U.S. Application Data

(60) Provisional application No. 62/634,350, filed on Feb. 23, 2018.

(51) Int. Cl.

| | |
|---|---|
| ***E05F 1/10*** | (2006.01) |
| ***E05F 3/12*** | (2006.01) |
| ***E05F 3/10*** | (2006.01) |

(52) U.S. Cl.

CPC ..... *E05F 3/12* (2013.01); *E05F 3/102* (2013.01); *E05Y 2201/212* (2013.01); *E05Y 2201/25* (2013.01); *E05Y 2201/256* (2013.01); *E05Y 2900/132* (2013.01)

(58) Field of Classification Search

CPC . E05F 1/1025; E05F 1/04; E05F 1/105; E05F 1/1041; E05F 1/1008; E05F 3/10; E05F 3/12; E05F 3/104; E05F 3/102; E05F 3/22; E05F 3/221; E05F 3/223; E05F 3/227; E05Y 2201/212; E05Y 2201/25; E05Y 2201/256; E05Y 2201/618; E05Y 2201/716; E05Y 2201/722; E05Y 2201/11; E05Y 2201/474; E05Y 2201/492; E05Y 2900/132; E05Y 2400/818; Y10T 16/577; Y10T 16/2804; Y10T 16/285; Y10T 16/293; Y10T 16/585; Y10T 16/299; Y10T 16/286; Y10T 16/27

See application file for complete search history.

(56) References Cited

U.S. PATENT DOCUMENTS

| | | | | |
|---|---|---|---|---|
| 2,244,161 A * | 6/1941 | Johnson | F16K 1/36 | 137/561 R |
| 2,293,903 A * | 8/1942 | Johnson | F16K 1/36 | 137/80 |
| 2,586,135 A * | 2/1952 | Woodruff | E05F 3/102 | 16/51 |
| 2,679,864 A * | 6/1954 | Harke | F16K 11/18 | 137/635 |

(Continued)

*Primary Examiner* — Chuck Y Mah

(74) *Attorney, Agent, or Firm* — Taft Stettinius & Hollister LLP

(57) ABSTRACT

A valve mechanism according to certain embodiments includes an adjustment screw and a rotatable control knob coupled with the adjustment screw. The valve mechanism includes a feedback mechanism operable to provide at least one of visual feedback, audible feedback, or tactile feedback to indicate movement and/or a positon of the adjustment screw within a door closer body.

25 Claims, 22 Drawing Sheets

(56) References Cited

U.S. PATENT DOCUMENTS 2,767,681 A * 10/1956 Pontius ..... F16K 37/0016 116/277
2,815,230 A * 12/1957 Howie ..... G05G 1/12 403/276
3,441,249 A * 4/1969 Aslan ..... F16K 47/10 251/333
3,512,550 A * 5/1970 Ammann ..... F16K 31/365 137/553
3,534,773 A * 10/1970 Dewberry ..... F16K 37/0016 137/553
4,195,552 A * 4/1980 Neff ..... F15B 13/02 137/493.8
4,378,612 A * 4/1983 Beers ..... E05F 3/12 16/49
4,386,446 A * 6/1983 Zunkel ..... E05F 3/12 16/58
4,573,238 A * 3/1986 Phillips ..... E05F 3/102 137/513.5
4,783,882 A * 11/1988 Frolov ..... E05F 3/10 16/79
5,187,835 A * 2/1993 Lee ..... E05F 3/104 16/51
5,414,894 A * 5/1995 Fayngersh ..... E05F 3/102 16/71
5,449,291 A 9/1995 Lueschen et al.
5,531,712 A * 7/1996 Malcolm ..... F16K 37/0016 116/201
5,954,192 A 9/1999 Iitsuka
6,282,750 B1 * 9/2001 Bishop ..... E05F 3/10 16/79
7,484,959 B2 2/2009 Porter et al.
D613,698 S * 4/2010 Radau ..... E05F 1/105 D13/169
8,167,910 B2 5/2012 Nilsson
8,377,139 B2 2/2013 Laubert et al.
8,506,601 B2 8/2013 Gephart et al.
8,551,141 B2 10/2013 Gephart et al.
8,732,905 B2 * 5/2014 Bell ..... E05F 3/102 16/71
8,777,954 B2 7/2014 McLean
8,900,240 B2 12/2014 White et al.
9,060,808 B2 6/2015 Overes et al.
9,419,420 B1 8/2016 Parrish
9,695,620 B2 * 7/2017 Zasowski ..... E05F 1/105
2011/0197391 A1 * 8/2011 Yu ..... E05F 3/104 16/51
2014/0331913 A1 * 11/2014 Emanuel ..... F16K 37/0016 116/201
2016/0273257 A1 * 9/2016 Hickman ..... E05F 3/00
2019/0145543 A1 * 5/2019 Huddleston ..... F16K 31/60 251/305
2019/0249784 A1 * 8/2019 Komatsuzaki ..... F16K 7/17

* cited by examiner

DOOR CLOSER APPARATUS AND METHOD

CROSS-REFERENCE TO RELATED APPLICATIONS

The present application claims the benefit of U.S. Provisional Patent Application No. 62/634,350, filed on Feb. 23, 2018, the contents of which are incorporated by reference in their entirety.

TECHNICAL FIELD

The present disclosure generally relates to a door closer with a fluid actuator speed control system and more particularly, but not exclusively to a valve mechanism having one or more feedback features to control fluid flow through the actuator control system.

BACKGROUND

Fluid actuated door closers are operable to control the speed in which a door moves during closing and/or opening. Fluid actuated door closers may have a piston in fluid communication with a series of fluid passages and valves. One or more adjustment screws can be used to control the flow rate of the fluid as the piston moves between open and closed positions. Typically, as the flow rate of fluid decreases through the actuator, the speed of the door will slow. Some prior art adjustment screws have certain disadvantages. Accordingly, there remains a need for further contributions in this area of technology.

SUMMARY

A valve mechanism according to certain embodiments includes an adjustment screw and a rotatable control knob coupled with the adjustment screw. The valve mechanism includes a feedback mechanism operable to provide at least one of visual feedback, audible feedback, or tactile feedback to indicate movement and/or a positon of the adjustment screw within a door closer body. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
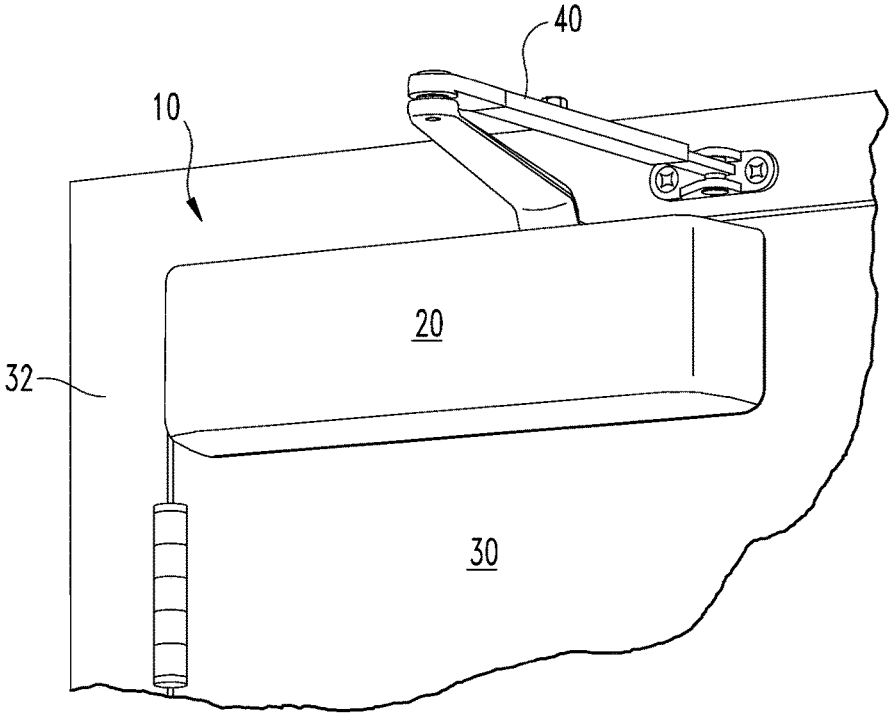
FIG. 1 is a perspective view of a portion of a door and a door closer assembly according to certain embodiments.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an exemplary door closer 10 is illustrated in a partial perspective view. The door closer 10 can include a closer body 20 that is operably connected to a door 30, and control arm 40 is connected between the door closer body portion 20 and a fixed door frame 32 to provide control of the closing and/or opening speed of the door 30. In the illustrated form, the body portion 20 is mounted to the door 30, and the control arm 40 is pivotably connected to the frame 32. In other embodiments, the body portion 20 may be mounted to the frame 32, and the control arm 40 may be pivotably connected to the door 30.

Figure 2:
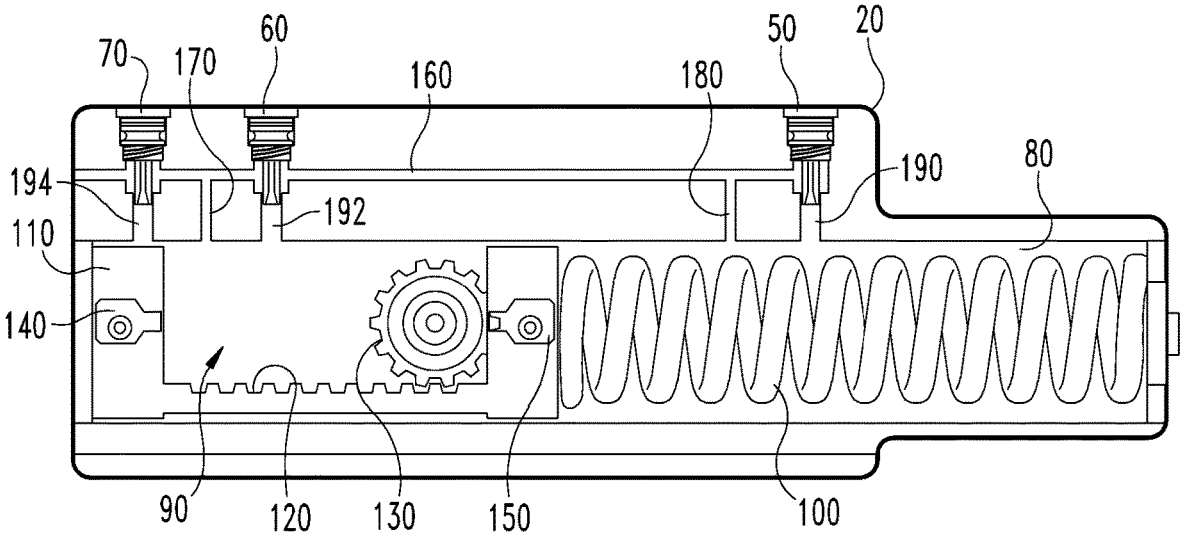
FIG. 2 is a cross-sectional view of the door closer assembly of FIG. 1.

Referring now to FIG. 2, the door closer body portion 20 can include one or more adjustment screws operable to vary the speed of the door 30. The exemplary embodiment includes three adjustment screws, a first adjustment screw 50, a second adjustment screw 60 and a third adjustment screw 70, however alternate embodiments may include a different number of adjustment screws. As described in further detail below, the adjustment screws 50, 60, 70 control the flow rate of a working fluid so as to control the speed in which the door either opens or closes. The adjustment screws include one or more feedback features including visual, audible and/or haptic features to indicate movement and/or a positon of the valve body within the door closer body portion 20.

The door closer body portion 20 can include a chamber 80 for holding a working hydraulic fluid 90 therein. The chamber 80 can further house a resilient member such as a coil spring 100 operably engaged with a piston 110. The piston 110 can include a rack gear 120 meshed with a pinion 130. A first check valve 140 and a second check valve 150 can be formed within portions of the piston 110 as is known to those skilled in the art. The check valves 140, 150 permit working fluid 90 to flow in one direction when the piston 110 is moving in a first direction and permits working fluid 90 to flow in the opposing direction when the piston 110 is flowing in an opposite second direction.

The body 20 further includes a primary channel 160 through which the working fluid 90 can flow, and the adjustment screws, 50, 60, 70, project into the primary channel 160 such that each screw 50, 60, 70 is operable to adjust an effective cross-sectional area of the channel 160 at a corresponding and respective location. A main port 170 extends from the chamber 80 to the primary channel 160 between the second and third adjustment screws 60, 70. A backcheck working fluid return port 180 extends from the chamber 80 to the primary channel 160 between the first and second adjustment screws 50, 60. A first working fluid port 190 is connected between the chamber 80 and first adjustment screw 50. A second working fluid port 192 is connected between the chamber 80 and the second adjustment screw 60. A third working fluid port 194 is connected between the chamber 80 and third adjustment screw 70. Each of the first, second and third adjustment screws 50, 60, 70 can be positioned so as to control the working fluid flow rate through the first, second and third ports 190, 192, 194 respectively, between the chamber 80 and the primary channel 160. The piston 110 is operably connected to the control arm 40 via the pinion 130 so as to transmit the opening or closing force on the door through the chamber 80 of the body 20. In this manner, a resistance to the flow of working fluid 90 can be varied to control the speed to which the door may close or open.

Referring now to FIG. 3A through 3D, a first exemplary embodiment of a valve mechanism 200 is illustrated therein. It should be noted that the various embodiments of valve mechanisms illustrated herein include many of the same features and may not necessarily be fully described in each respective embodiment. The valve mechanism 200 includes a control knob 202 and an adjustment screw 203 operably connected with the control knob 202. In the illustrated form, the adjustment screw 203 includes a threaded portion 224, a valve body 220 positioned on one side of the threaded portion 224, and a drive tang 226 extending from an opposite side of the threaded portion 224.

Figure 3A:
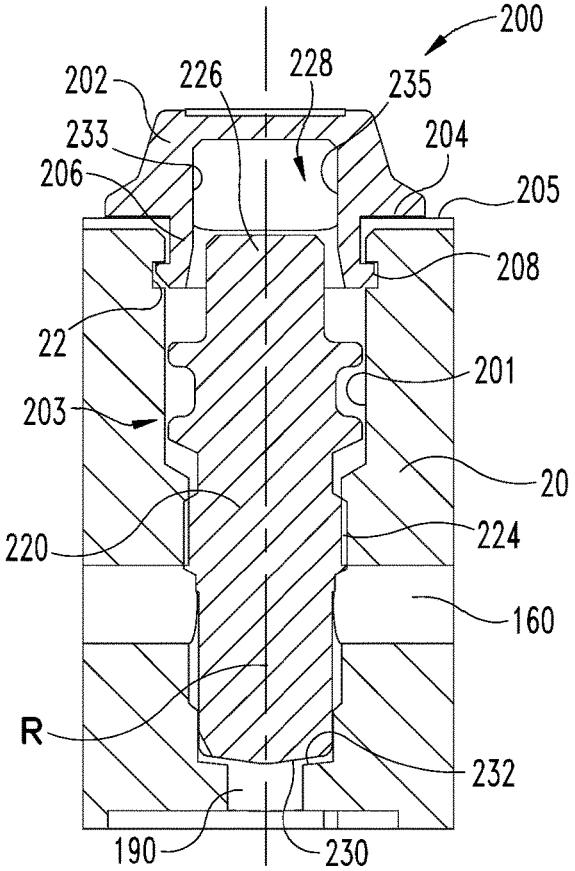
FIG. 3A is a cross-sectional view of an exemplary valve mechanism according to certain embodiments.
Figure 3B:
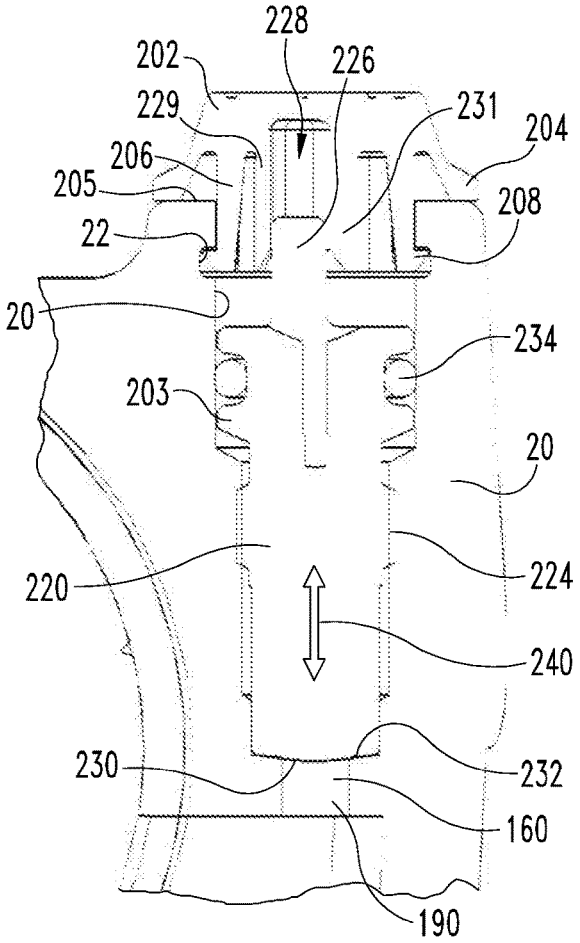
FIG. 3B is a cross-sectional view of the exemplary valve mechanism shown rotated 90° from the view shown in FIG. 3A.
Figure 3C:
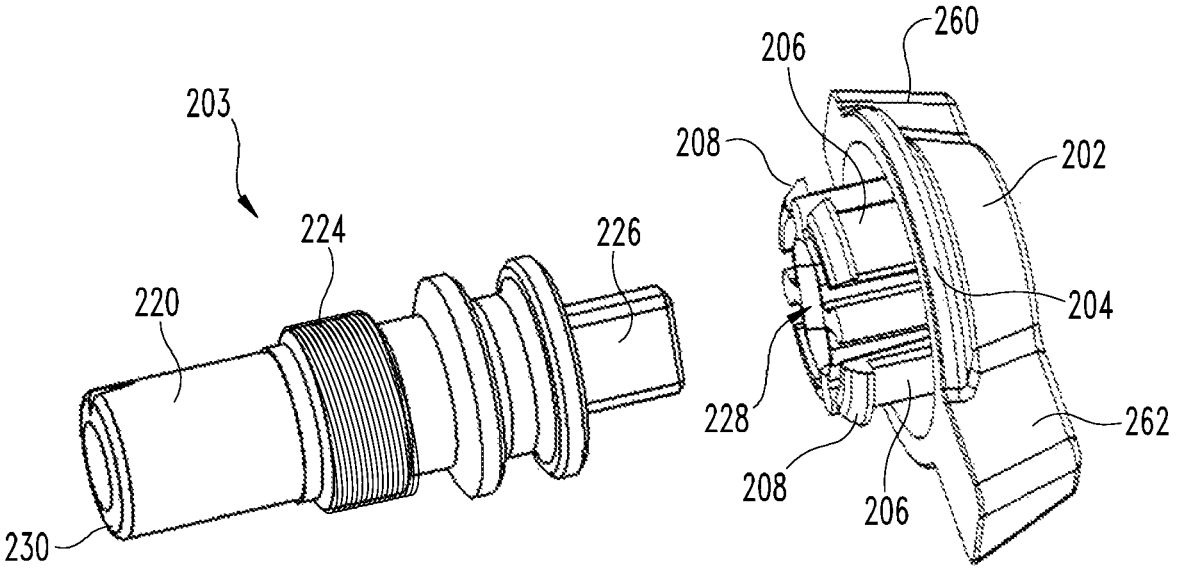
FIG. 3C is perspective exploded view of a body portion and a control knob of the exemplary valve mechanism shown in FIG. 3A.

FIG. 3A shows a cross-sectional view of a portion of the closer body 20 with the valve mechanism 200 seated in a bore 201 formed in the body 20. As noted above, the valve mechanism 200 includes a manual actuator in the form of a control knob 202, which is operably connected to a valve body 220 such that as the control knob 202 is rotated, the valve body 220 will be raised and lowered as depicted by double arrow 240 in FIG. 3B. The control knob 202 can include a flange 204 that rotatably engages with a top wall 205 of the body 20. In other forms, the flange 204 of the control knob 202 may not necessarily engage with the top wall 205. In certain forms, the flange 204 may interface with one or more intermediary components positioned between the control knob 202 and the top wall 205 of the body 20 as is illustrated in certain embodiments disclosed herein.

A leg or rim 206 extends downward from the flange 204 and into the bore 201 of the body 20. It should be noted that the use of words such as up, down, left, right, under and above or the like are not defined in the absolute sense, but merely descriptors of features illustrated in the disclosed views. In some forms, the leg 206 can be a plurality of discrete members, and in other forms can be circumferentially uniform around the control knob 202. A lip 208 extends or projects radially outward from each leg 206. The lip 208 is configured to slip or snap into a circumferential slot 22 formed around the internal section of the bore 201. In this manner the control knob 202 can be fixed to the body 20 in an axial direction along axis R while permitting rotational movement about the axis of rotation R as shown in FIG. 3A.

The adjustment screw 203 is threadedly engaged with the body 20 at a thread interface 224 so that as the control knob 202 is rotated, the adjustment screw 203 will rotate about the axis R and be raised or lowered in an axial direction illustrated by double arrow 240. The adjustment screw 203 further includes a drive tang 226 extending into a drive slot 228 formed within the control knob 202. In one form, the drive tang 226 can have a rectangular shape having relatively longer longitudinal side and a relatively short lateral side. Other shapes or configurations of the drive tang 226 and drive slot 228 are contemplated herein. The drive slot 228 can include first and second sidewalls 229, 231 that are spaced so as to engage a shorter lateral opposing sides of the drive tang 226 (see FIG. 3B) and another pair of sidewalls 233, 235 spaced apart to engage the drive tang 226 along the longitudinal side of the drive tang 226.

The bore 201 terminates at a bore seat 232 near the distal end of the valve body 220. The valve body 220 includes a seat interface portion 230 that is configured to form a variable flow area with the bore seat 232 so as to control a fluid flow rate between an inlet port 190, 192 or 194 and the primary channel 160 as illustrated in FIG. 2. One or more seals 234, such as an O-ring seal, can be positioned between the adjustment screw 203 and the bore 201 to prevent the working fluid 90 from passing through the top end of the bore 201 through the user interface region of the control knob 202.

Figure 3D:
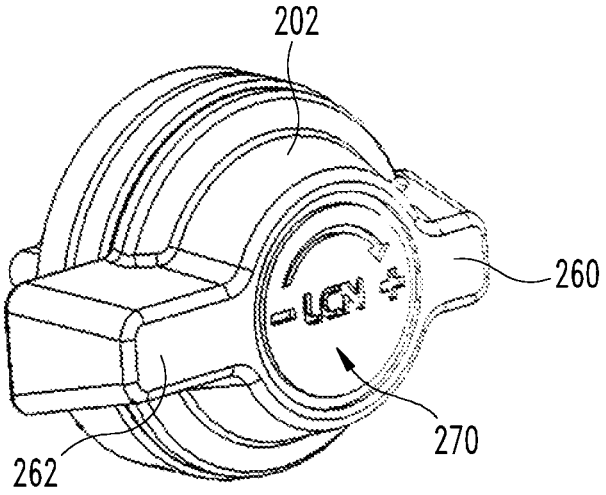
FIG. 3D is another perspective view of the control knob shown in FIG. 3C.

Referring more particularly to FIG. 3D, the control knob 202 can include first and second lever arms 260, 262. In one form, the second lever arm 262 can be a different size than that of the first lever arm 260 so as to provide a visual indication of the angular position of the control knob 202. Another visual indicator 270 can include an arrow pointing towards a plus sign and away from the negative sign to show a direction of increasing opening of the valve body 220.

A user may manually adjust an operating characteristic of the door closer 10 by operating the valve mechanism 200. As will be appreciated, the adjustment screw 203 of the valve mechanism 200 may be employed as any of the adjustment screws 50, 60, 70, and the operating characteristic adjusted by manipulation of the adjustment screw 203 will correspond to the adjustment screw 50, 60, 70 being adjusted. For example, in embodiments in which the adjustment screw 203 is implemented as the backcheck adjustment screw, manipulation of the valve mechanism 200 will adjust the backcheck operating characteristic of the closer 10.

The user may adjust the position of the valve body 220 without requiring the use of separate tools due to the provision of the control knob 202, which is engaged with the adjustment screw 203 via the drive tang 226 as described above. As the user rotates the control knob 202, such rotation is transmitted to the adjustment screw 203, thereby causing the valve body 220 to raise or lower, depending upon the direction of rotation. As noted above, the direction of rotation that will cause raising or lowering of the valve body 220 is indicated by the visual indicator 270. Additionally, the position of the valve body 220 is indicated by the lever arms 260, 262, thereby providing the user with visual feedback related to the current position of the valve body 220.

Referring now to FIGS. 4A-4D, another exemplary embodiment of a valve mechanism 300 is illustrated. The valve mechanism 300 can include a control knob 302 that can interface with the body 20 and an adjustment screw 203 in similar fashion to that described with the embodiment of FIG. 3A-3D. However, the valve mechanism 300 includes a case 330 positioned between the control knob 302 and the body 20. The case 330 is configured to provide visual feedback in the form of a visual indicator 321 of the valve position. The visual indicator 321 provides an indicator value 322 that corresponds to a position of the valve body 220 within the bore 201. The case 330 can include a first arcuate portion 332 that can be similar in shape and size to that of the control knob 302. A second arcuate portion 334 houses the visual indicator 321 and includes a cover 336 with a window 338 formed therethrough. The indicator value 322 can be viewed through the window 338 to provide an indication of the position of the valve body 220. The indicator value 322 will change in magnitude as the control knob 302 is rotated and moves the valve body 220 between a first position such as a closed position and a second position such as a fully opened position.

Figure 4A:
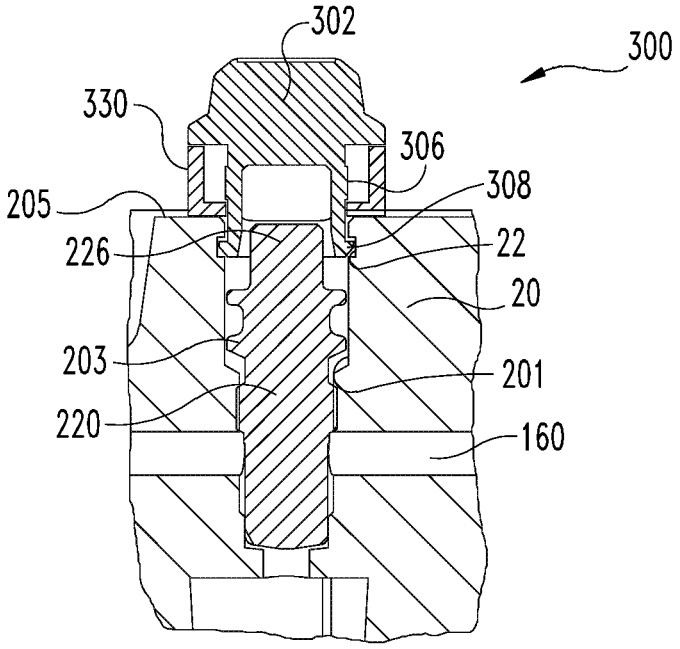
FIG. 4A is a cross-sectional view of a valve mechanism according to certain embodiments.
Figure 4B:
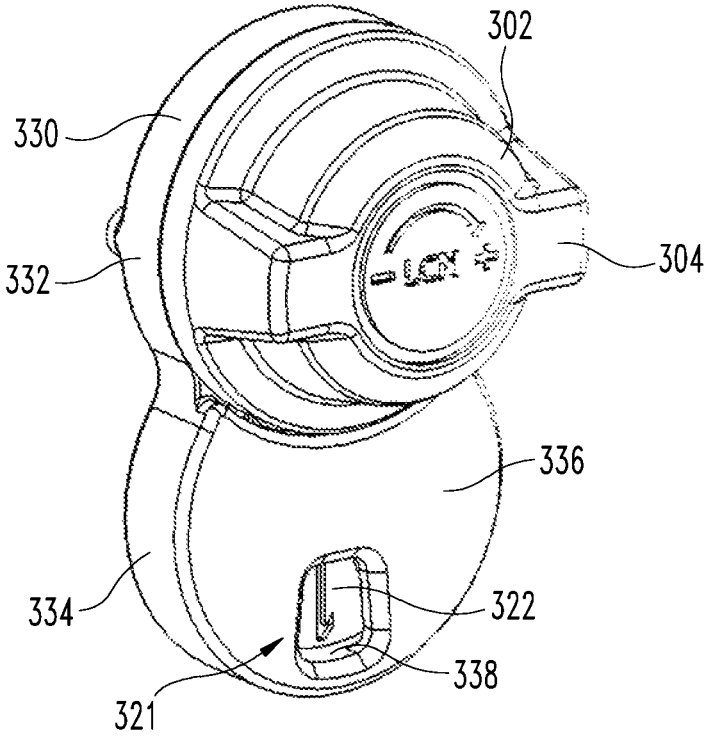
FIG. 4B is a perspective view of a control knob with a position indicator for the valve mechanism of FIG. 4A.
Figure 4C:
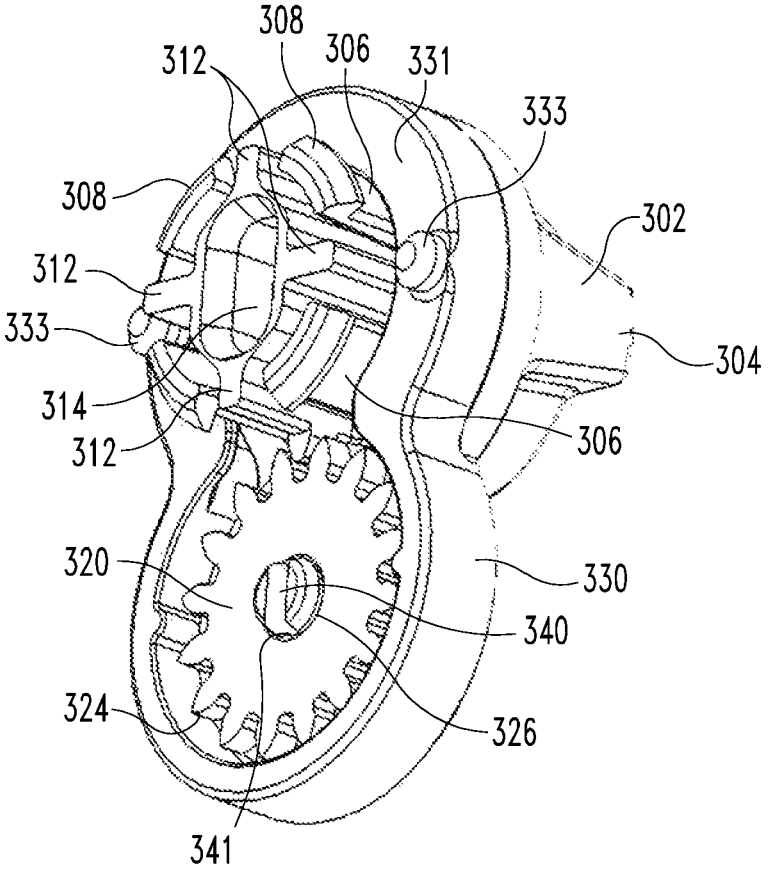
FIG. 4C is another perspective view of the control knob of FIG. 4B.
Figure 4D:
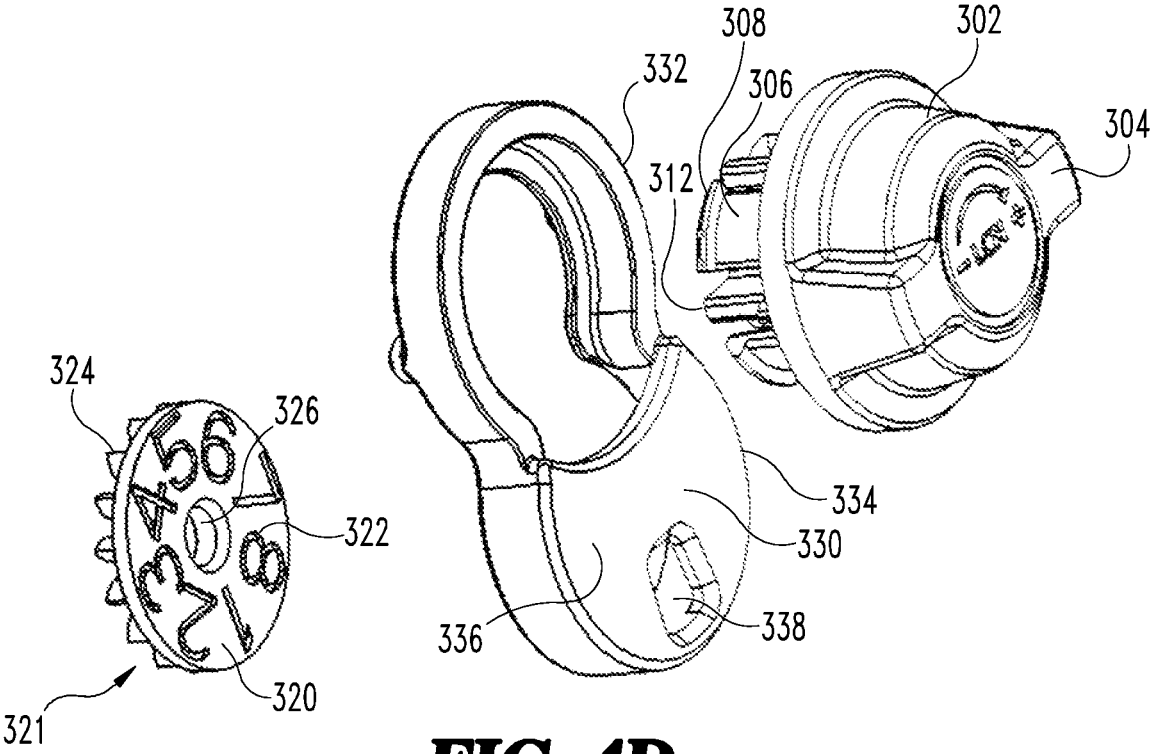
FIG. 4D is another perspective exploded view of the control knob of FIG. 4B.
Figure 5A:
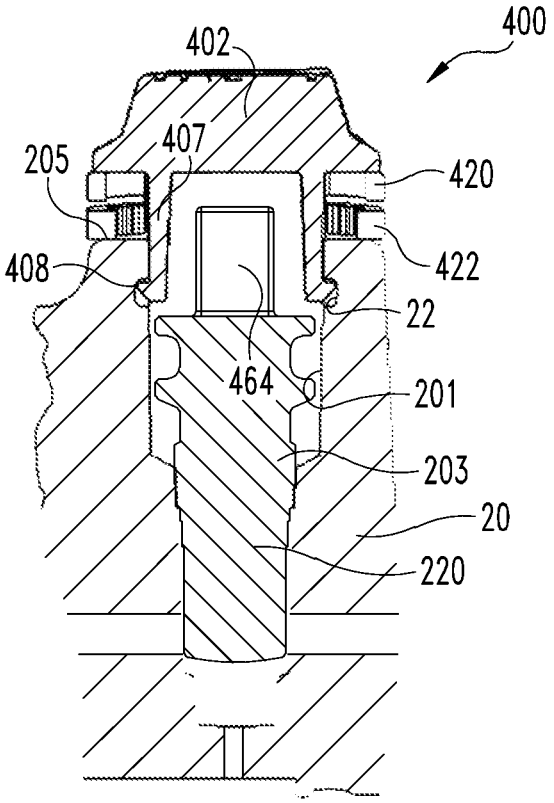
FIG. 5A is a cross-sectional view of a valve mechanism according to certain embodiments.
Figure 5C:
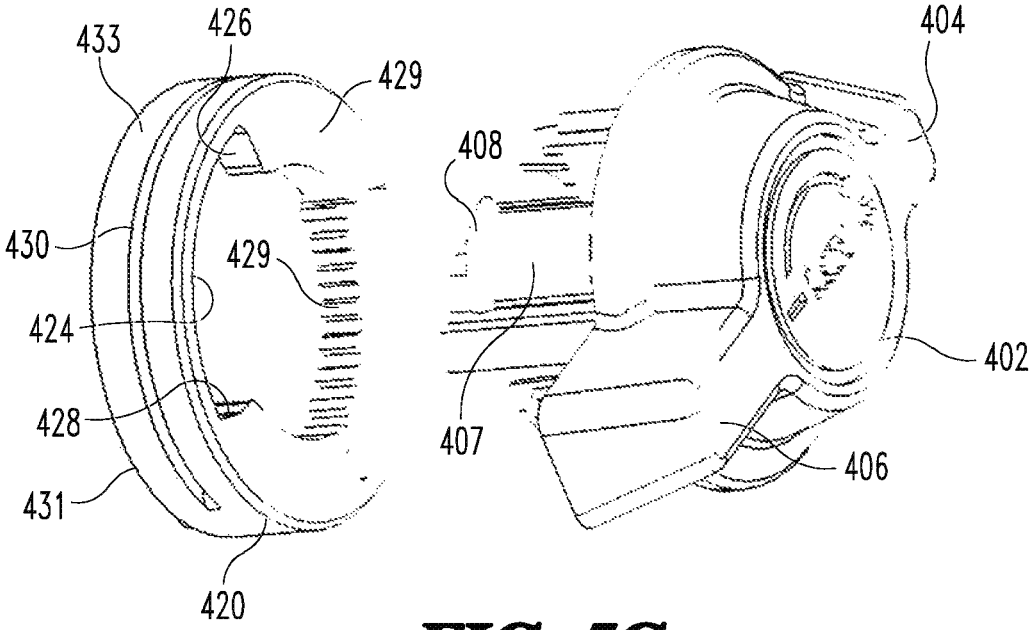
FIG. 5C is another perspective view of a portion of the valve mechanism of FIG. 5A.
Figure 5B:
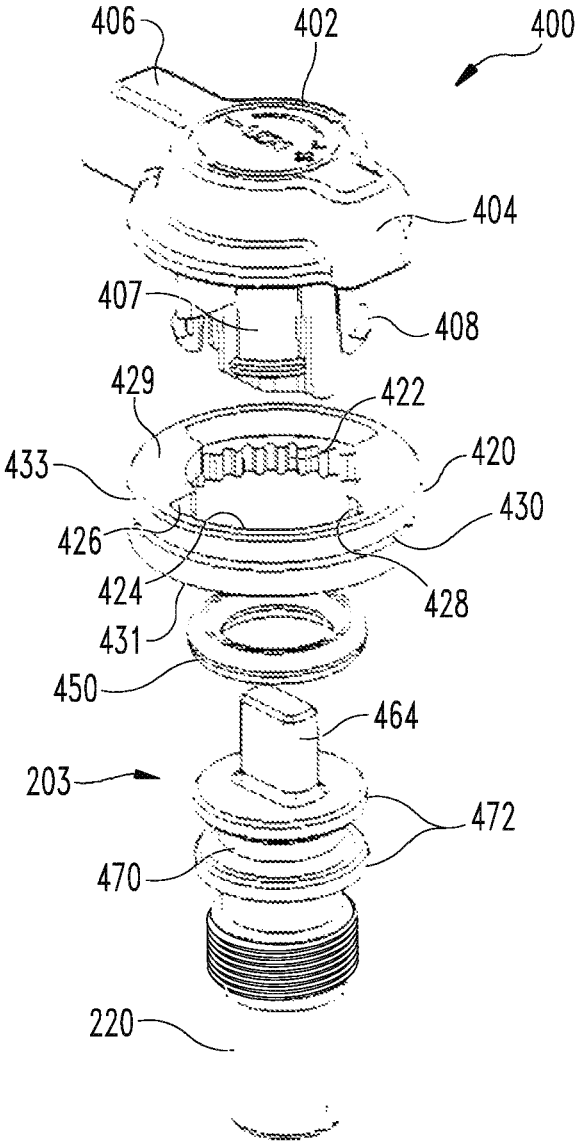
FIG. 5B is an exploded perspective view of a valve mechanism of FIG. 5A.
Figure 5D:
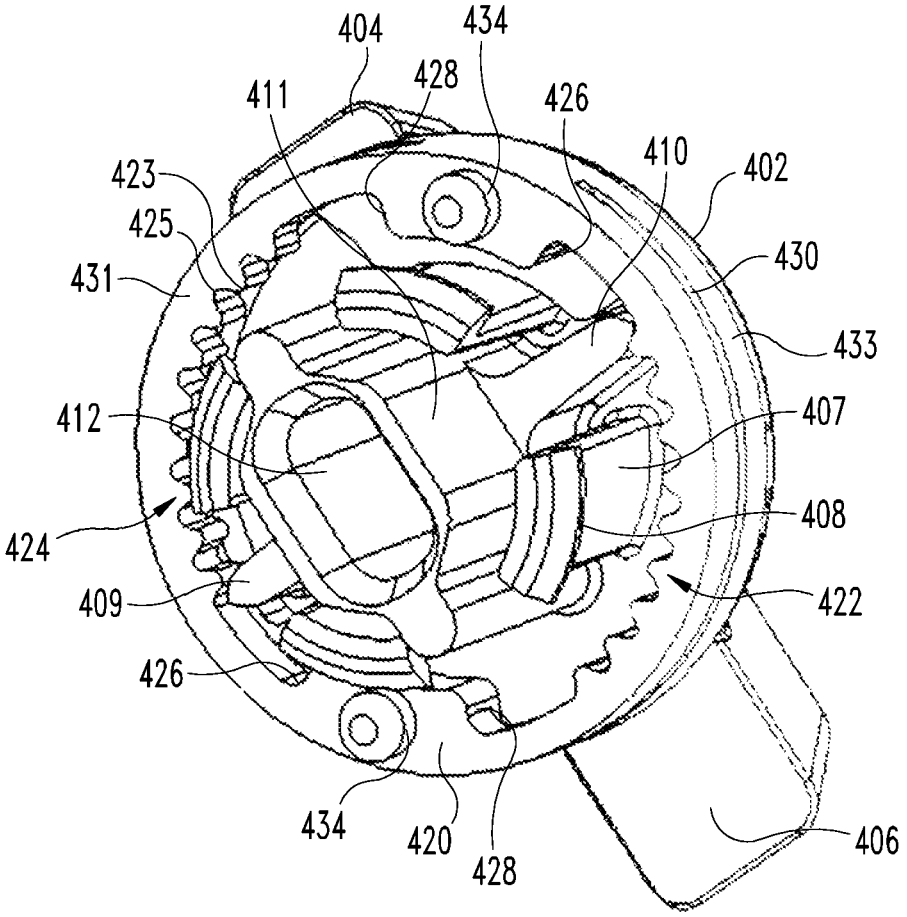
FIG. 5D is another perspective view of the underside of the control knob for the valve mechanism of FIG. 5A.

Referring more particularly to FIGS. 4C and 4D, the case 330 can include a flange face 331 that is configured to engage with the top wall 205 of the body 20. One or more locating posts 333 can extend from the flange face 331 and into receiving bores formed within the top wall 205 of the body 20. The locating posts 333 are operable as an anti-rotation feature as the posts 333 prevent the case 330 from rotating when the control knob 302 is rotated.

The control knob 302 includes at least one drive tooth 312, and in the disclosed form includes four drive teeth 312 to interface with and rotate an indicator wheel 320. The indicator wheel 320 includes indicator values 322 on one side thereof and a plurality of gear teeth 324 extending from the other side thereof. The indicator values 322 are illustrated as numeric values in the disclosed embodiment, however it should be understood that the indicator values 322 can be alphanumeric or other graphical symbols representing a relative position of the valve body 220. The indicator values 322 can be viewed through the window 338 of the case 330.

The control knob 302 includes a drive slot 314 that has a shape configured to rotationally couple with the drive tang 226 of the adjustment screw 203. The shape of the drive slot 314 can be similar to that of the drive tang 226, however the drive slot 314 can also include shapes other than what is depicted in the drawings. The indicator wheel 320 includes a through aperture 326 configured to receive and engage around a pivot pin 340 that extends from the cover 336 of the case 330. The pivot pin 340 can include a clip 341 that extends radially outward of the aperture 326 so as to prevent inadvertent disengagement of the indicator wheel 320 from the case 330.

A user may manually adjust an operating characteristic of the door closer 10 by operating the valve mechanism 300. As will be appreciated, the adjustment screw 203 of the valve mechanism 300 may be employed as any of the adjustment screws 50, 60, 70, and the operating characteristic adjusted by manipulation of the valve mechanism 300 will correspond to the adjustment screw 50, 60, 70 being adjusted. For example, in embodiments in which the adjustment screw 203 is provided as the main swing adjustment screw, manipulation of the valve mechanism 300 will adjust the operation of the closer 10 during the main swing of the door.

The user may adjust the position of the valve body 220 without requiring the use of separate tools due to the provision of the control knob 302, which is engaged with the adjustment screw 203 via the drive tang 226 as described above. As the user rotates the control knob 302, such rotation is transmitted to the adjustment screw 203, thereby causing the valve body 220 to raise or lower, depending upon the direction of rotation. Rotation of the control knob 302 also causes rotation of the indicator wheel 320 in a corresponding direction, thereby altering the indicia that is displayed via the window 338. As a result, the displayed indicium provides to the user a visual feedback regarding the position of the valve body 220, and thus of the degree to which the corresponding fluid flow path is open or closed.

Referring now to FIGS. 5A-5D, another exemplary embodiment of a valve mechanism 400 is illustrated therein. The valve mechanism 400 can include a control knob 402 having first and second lever arms 404, 406, as described in previous embodiments. One or more legs 407 extend from the control knob 402, and each includes a lip 408 projecting radially outward to releasably lock into the circumferential groove 22 of the bore 201 of the body 20. A first ear 409 and a second ear 410 (FIG. 5D) extend outward from an outer wall 411 of a drive slot 412. The first and second ears 409, 410 operate to engage a non-uniform surface to provide an audible noise and variable resistance during rotation of the control knob 402, as will be described in further detail below.

A sleeve 420 can be positioned between the control knob 402 and the top wall 205 of the body 20. The sleeve 420 can include one or more serration regions 422, 424 formed on a portion of the inner diameter of the sleeve 420. The first and second ears 409, 410 engage with the serration region 422, 424 of the sleeve 420 such that when the control knob 402 is rotated, a variable resistance and audible sound is generated by the ears 409, 410 as they traverse across the peaks 423 and valleys 425 of the serration regions 422, 424. In this manner, an operator can feel and hear each segmented movement during rotation of the control knob 402.

The sleeve 420 can include an upper face 429 and a lower face 431 with at least one circumferential slot 430 formed in a portion of a circumferential sidewall 433 extending between the upper and lower faces 429, 431. A first abutment 426 and a second abutment 428 extend radially inward from the sidewall 433 at opposite ends of each serration region 422, 424. The first and second ears 409, 410 can travel between the first and second abutments 426, 428. The abutments 426, 428 prevent over-tightening or over-loosening of the adjustment screw 203. A drive tang 464 of the screw body 220 is engagable within the drive slot 412 of the control knob 402 so as to permit transmission of rotational torque between the control knob 402 and the screw body 220. A seal 450 can be positioned within a seal groove 470 formed between outwardly projecting shoulders 472 below the drive tang 464.

A user may manually adjust an operating characteristic of the door closer 10 by operating the valve mechanism 400. As will be appreciated, the adjustment screw 203 of the valve mechanism 400 may be employed as any of the adjustment screws 50, 60, 70, and the operating characteristic adjusted by manipulation of the valve mechanism 400 will correspond to the adjustment screw 50, 60, 70 being adjusted. For example, in embodiments in which the adjustment screw 400 is provided as the latch region adjustment screw, manipulation of the valve mechanism 400 will adjust the operating characteristics of the closer 10 during the latching movement of the door.

The user may adjust the position of the valve body 220 without requiring the use of separate tools due to the provision of the control knob 402, which is engaged with the adjustment screw 203 via the drive tang 464 as described above. As the user rotates the control knob 402, such rotation is transmitted to the valve body 220, thereby causing the valve body 220 to raise or lower, depending upon the direction of rotation. When the control knob 402 is rotated, a variable resistance and audible sound is generated by the ears 409, 410 as they traverse across the peaks 423 and valleys 425 of the serration regions 422, 424, thereby providing to the user audible and tactile feedback related to movement of the adjustment screw 400.

Figure 6A:
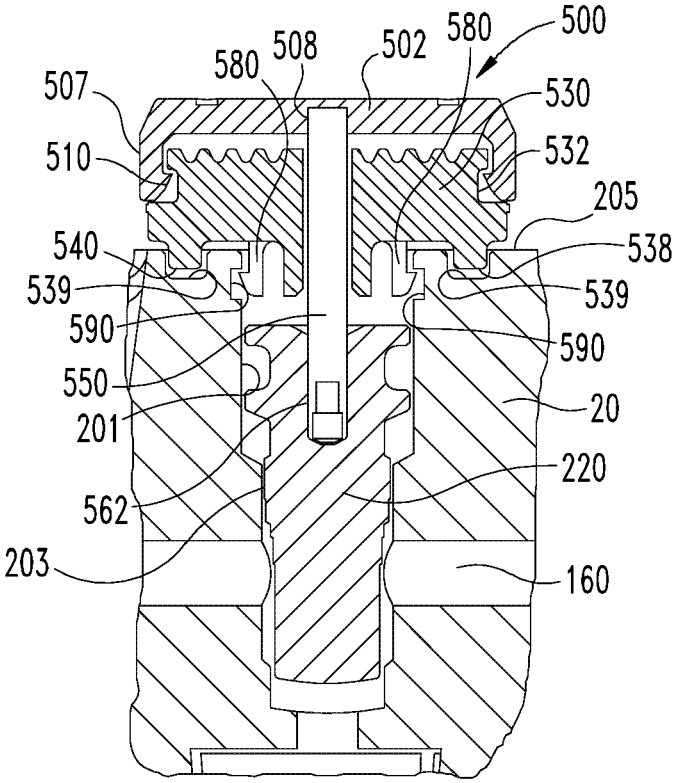
FIG. 6A is a cross-sectional view of a valve mechanism according to certain embodiments.
Figure 6B:
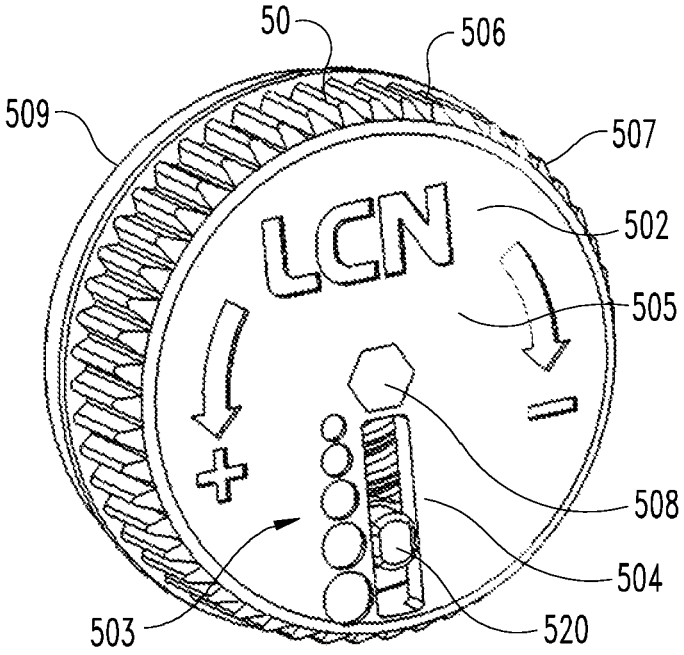
FIG. 6B is a perspective view of a control knob for the valve mechanism of FIG. 6A.
Figure 6C:
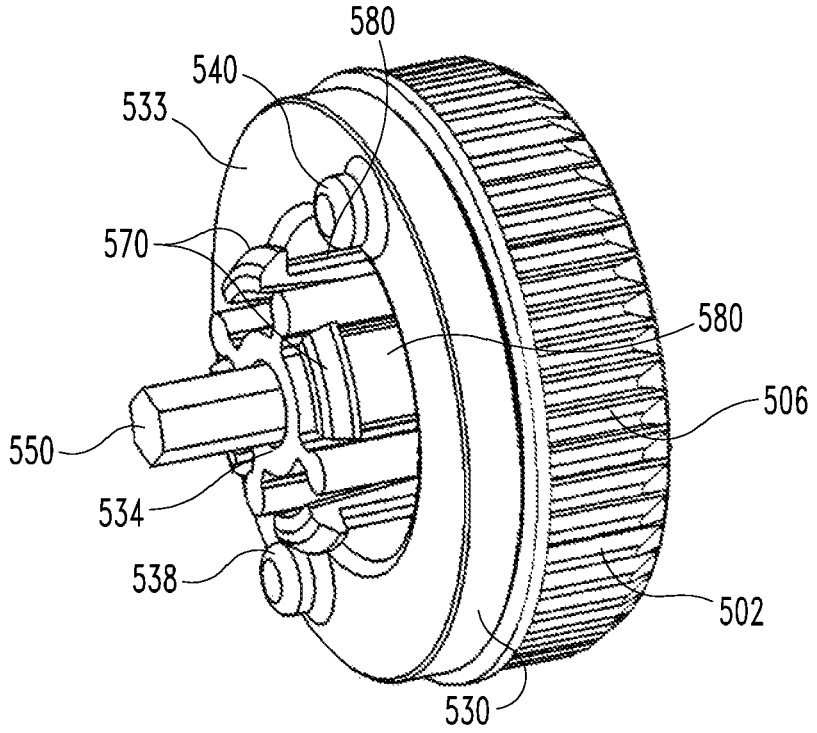
FIG. 6C is another perspective view of a valve mechanism of FIG. 6A.
Figure 6D:
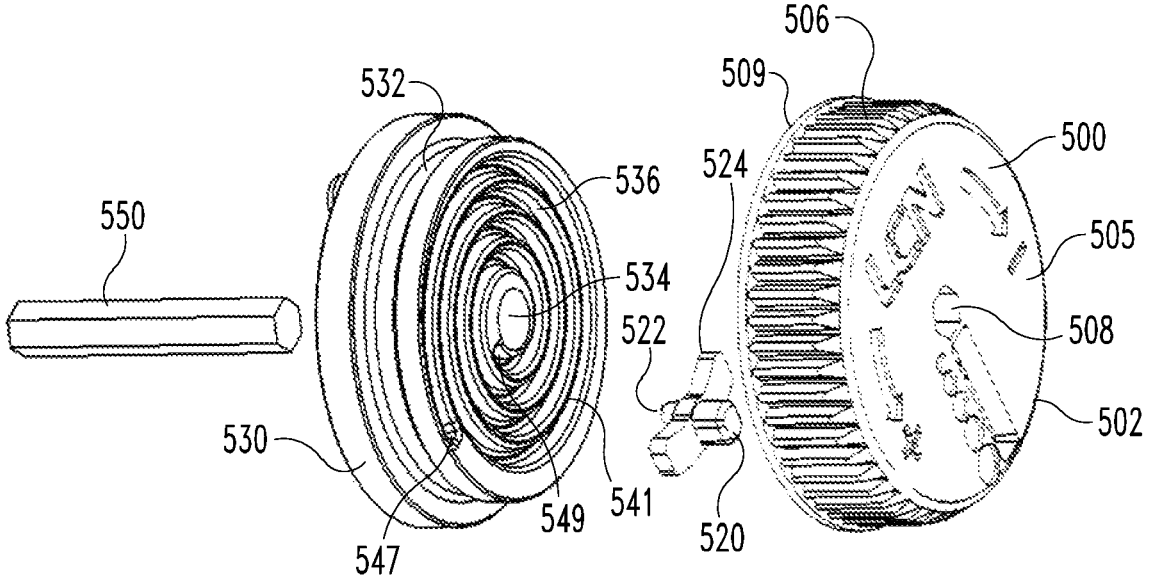
FIG. 6D is an exploded perspective view of the control knob, a knob seat, and a drive shaft of the valve mechanism of FIG. 6A.

Referring now to FIGS. 6A through 6B, a valve mechanism 500 is illustrated in yet another embodiment. The valve mechanism 500 includes a control knob 502 with a visual indicator 503 formed therewith. A slot 504 is formed through a top wall 505 of the control knob 502 as part of the visual indicator 503. A grip feature 506, such as knurling or the like, is formed around an outer perimeter 507 of the control knob 502. The grip feature 506 is formed around the perimeter 507 defined between the top wall 505 and the bottom wall 509 of the control knob 502. A coupling aperture 508 is formed through the top wall 505. The coupling aperture 508 is configured to transmit torque from the control knob 502 to the adjustment screw 203 and will be described in more detail below. In the disclosed embodiment, the coupling aperture 508 is a hexagon, however other configurations are contemplated herein.

A clip arm 510 extends from the top wall 505 along the perimeter 507 and into a clip groove 532 formed in a knob seat 530. The clip arm 510 extends into the clip groove 532 and is operable to permit relative rotational engagement of the clip arm 510 with respect to the clip groove 532 while holding the control knob 502 in a fixed axial position relative to the knob seat 530. The knob seat 530 includes a through aperture 534 positioned proximate the center thereof. A spiral groove 536 is formed in the knob seat 530, and extends from an outer end abutment 547 to an inner end abutment 549.

An indicator pin 520 includes a follower guide 522 that extends into the spiral groove 536 of the knob seat 530. The indicator pin 520 extends through the slot 504 of the control knob 502 to provide a visual indication of the position of the valve body 220 of the valve mechanism 500. A bushing pad 524 is positioned between the follower guide 522 and the indicator pin 520 to provide a surface configured to ride along an outer edge 541 of the spiral groove 536 as the indicator pin 520 moves along the spiral groove 536 when the drive shaft 550 extends through the aperture 534 of the knob seat 530 and into the coupling aperture 508 of the control knob 502.

The drive shaft 550 is connected to a slot coupling 562 formed within the adjustment screw 203. The knob seat 530 includes a seat face 533 that is positioned proximate the top wall 205 of the body 20. First and second posts 538, 540 project away from the seat face 533 and extend into a pair of receptacles 539 formed in the top wall 205 of the body 20. The posts 538, 540 are configured to prevent the knob seat 530 from rotating relative to the body 20 when the control knob 502 is rotated during opening and closing of the valve body 220. The knob seat 530 further includes a lip 570 formed on a distal end of one or more legs 580 extending from the seat face 533 of the knob seat 530. The lip 570 can be positioned within a groove 590 formed within a sidewall of the bore 201 of the body 20 to provide axial retention of the knob seat 530 with the body 20.

A user may manually adjust an operating characteristic of the door closer 10 by operating the valve mechanism 500. As will be appreciated, the adjustment screw 203 of the valve mechanism 500 may be employed as any of the adjustment screws 50, 60, 70, and the operating characteristic adjusted by manipulation of the valve mechanism 500 will correspond to the adjustment screw 50, 60, 70 being adjusted. For example, in embodiments in which the adjustment screw 203 is provided as the latch region adjustment screw, manipulation of the valve mechanism 500 will adjust the operating characteristics of the closer 10 during the latching movement of the door.

The user may adjust the position of the valve body 220 without requiring the use of separate tools due to the provision of the control knob 502, which is engaged with the adjustment screw 203 via the drive shaft 550 as described above. As the user rotates the control knob 502, such rotation is transmitted to the adjustment screw 203, thereby causing the valve body 220 to raise or lower, depending upon the direction of rotation. Rotation of the control knob 502 also causes the indicator pin 520 to travel within the spiral groove 536, thereby causing the indicator pin 520 to travel along the slot 504. Thus, the position of the indicator pin 520 corresponds to the position of the valve body 220 and provides a positive visual indication of the position of the valve body 220 within the flow path.

Figure 7A:
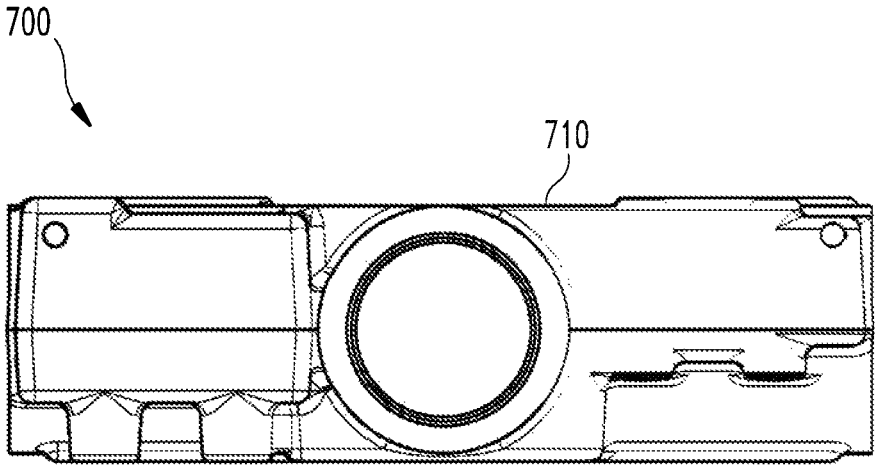
FIGS. 7A-7F respectively show a top view, front view, bottom view, left side view, right side view, and back view of a closer housing according to certain embodiments.
Figure 7B:
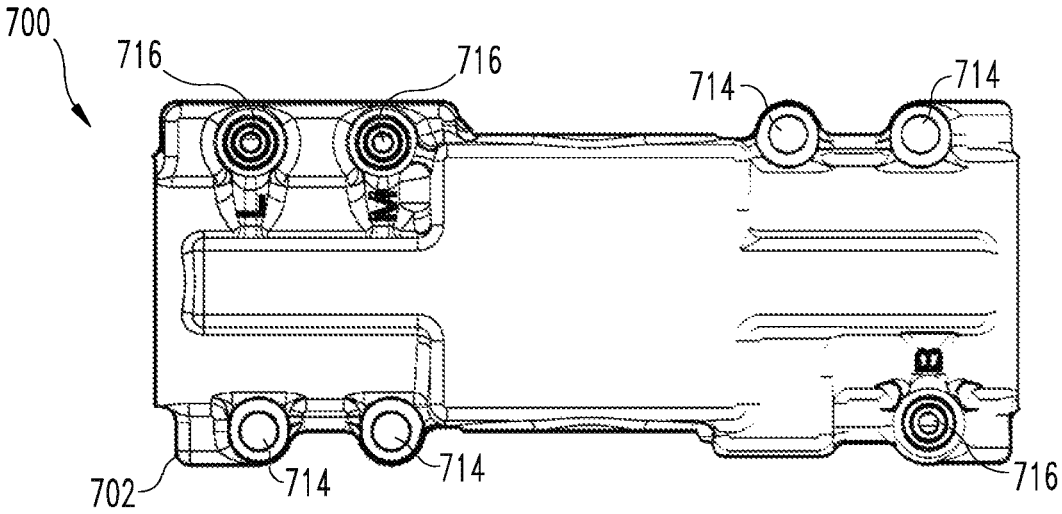
Figure 7C:
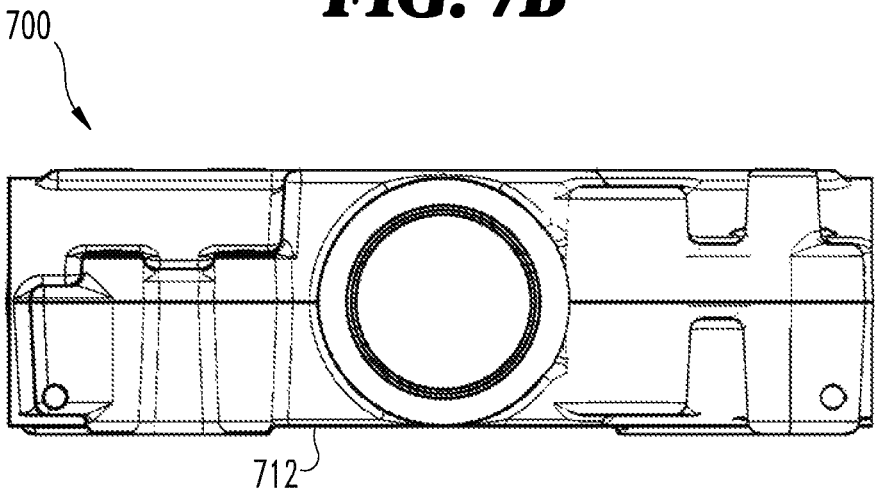
Figure 7D:
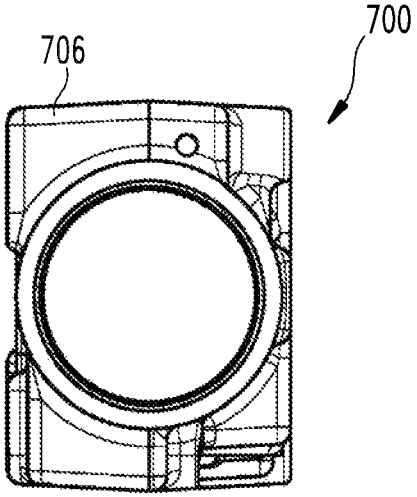
Figure 7E:
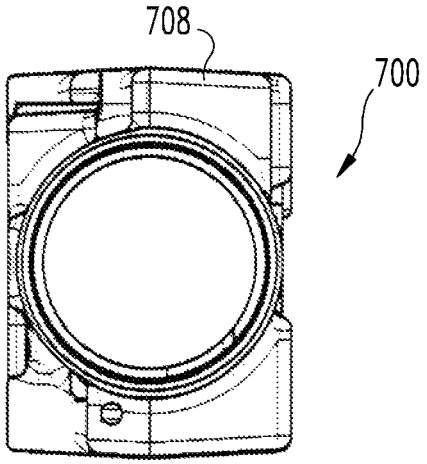
Figure 7F:
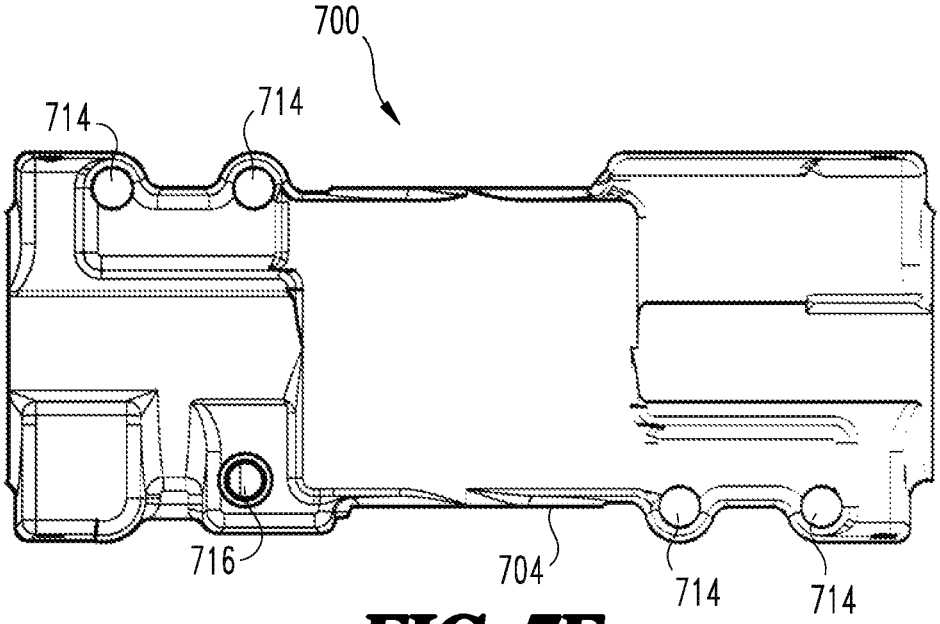
Figure 7G:
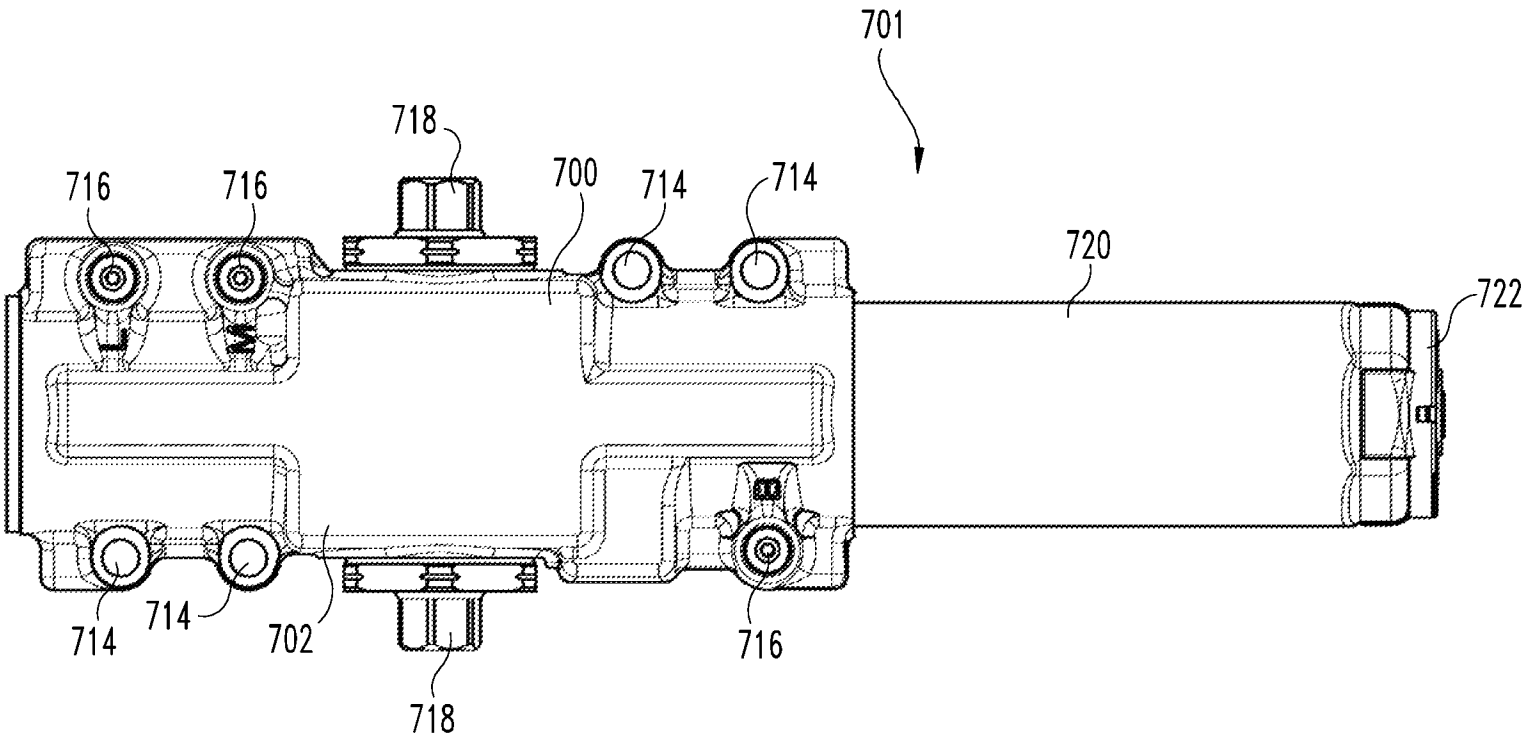
FIG. 7G is a front plan view of a closer body including the closer housing of FIGS. 7A-7F with a spring tube assembled therewith.

Referring now to FIGS. 7A-7G, illustrated therein is a closer body 701 according to certain embodiments. The closer body 701 includes a housing 700 having a spring tube 720 (FIG. 7G) assembled therewith. The housing 700 has a top 710 (FIG. 7A), a front 702 (FIG. 7B), a bottom 712 (FIG. 7C), a left side 706 (FIG. 7D), a right side 708 (FIG. 7E), and a back 704 (FIG. 7F). The closer body 700 includes one or more attachment apertures 714 and in the disclosed embodiment includes four attachment apertures 714 configured to receive fasteners (not shown) for connecting the closer body 700 to a movable structure such as a door or a static structure such as a wall or the like. At least one valve mechanism 716 is operably connected to the closer body 700. The valve mechanisms 716 can be provided as any of types previously disclosed herein. In some forms, one or more of the adjustment screws may be replaced with an accessibility selector or a removable plug or the like.

In the illustrated embodiment, the closer body 700 includes three valve mechanisms 716 positioned on the front 702 of the closer body 701 and one valve mechanism 716 positioned on the back 704 of the closer body 701. In other forms, the closer body 700 can include a different number of valve mechanisms positioned on the front 702 or the back 704 thereof. The closer body 701 may further include a packing nut 718 configured to hold a bearing assembly and pinion in a desired location therein. A spring tube 720 can be operably assembled with the housing 700 so as to provide a closing force to the door. A spring force within the spring tube 720 can be adjusted by way of a spring power adjustor 722 positioned on an end thereof.

Figure 8A:
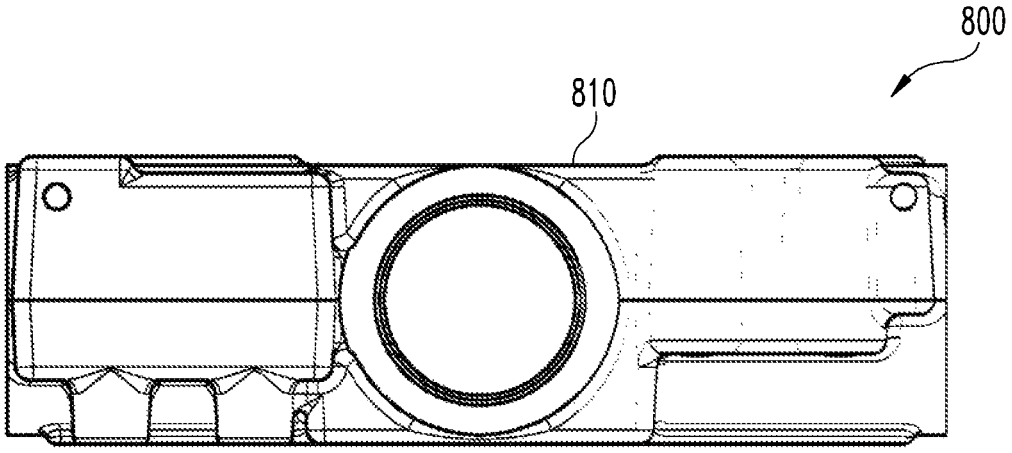
FIGS. 8A-8F respectively show a top view, front view, bottom view, left side view, right side view, and back view of a closer housing according to certain embodiments.
Figure 8B:
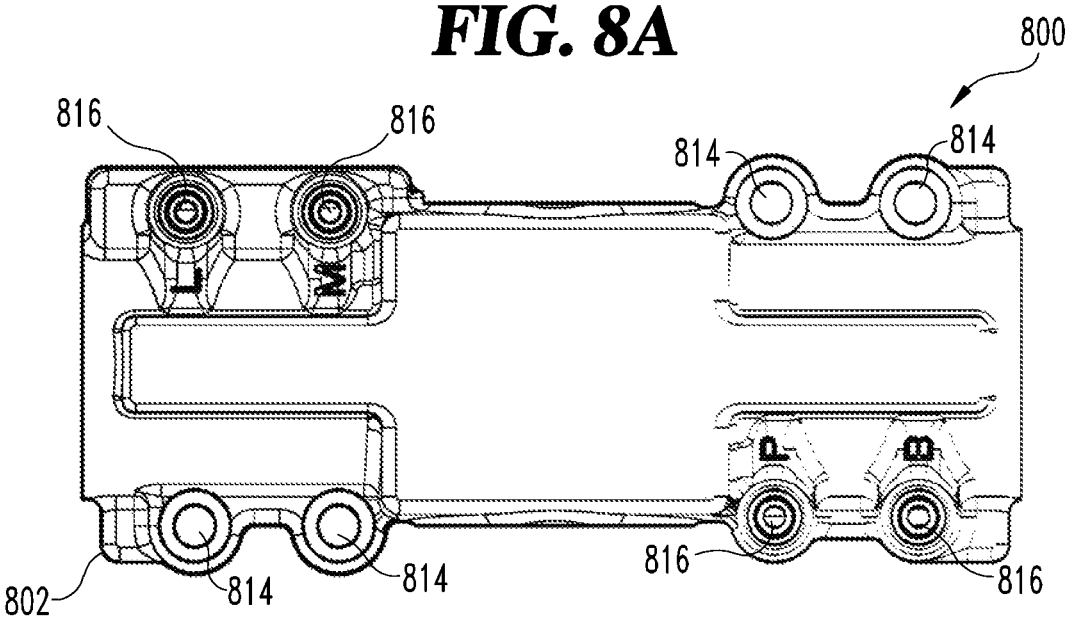
Figure 8C:
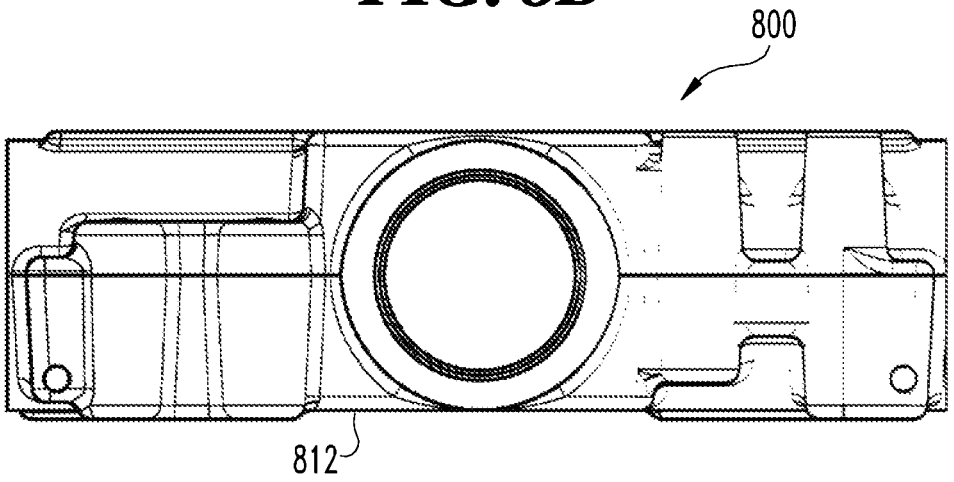
Figure 8D:
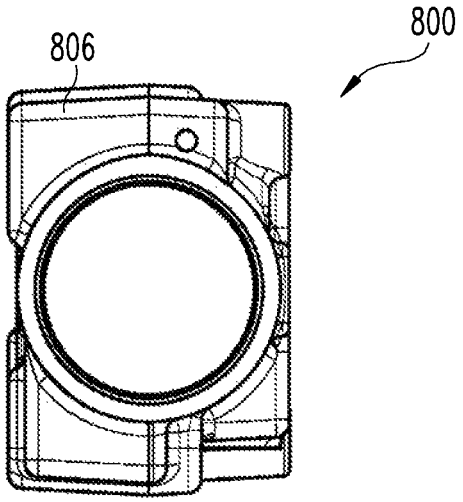
Figure 8E:
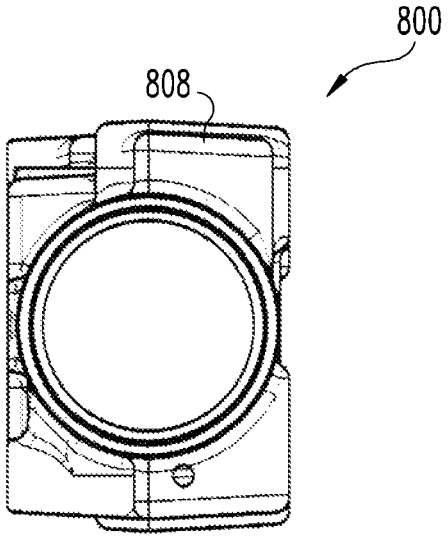
Figure 8F:
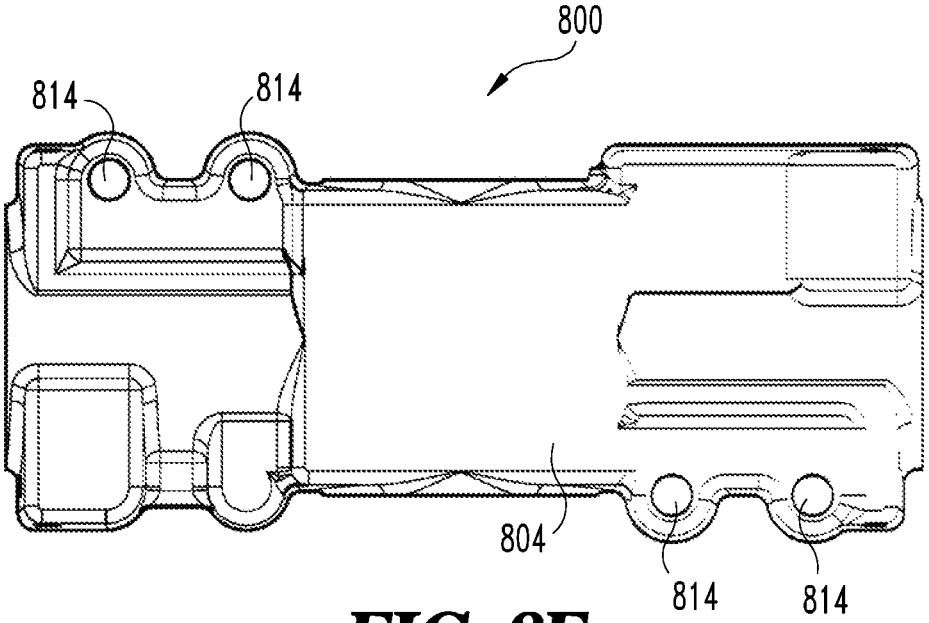
Figure 8G:
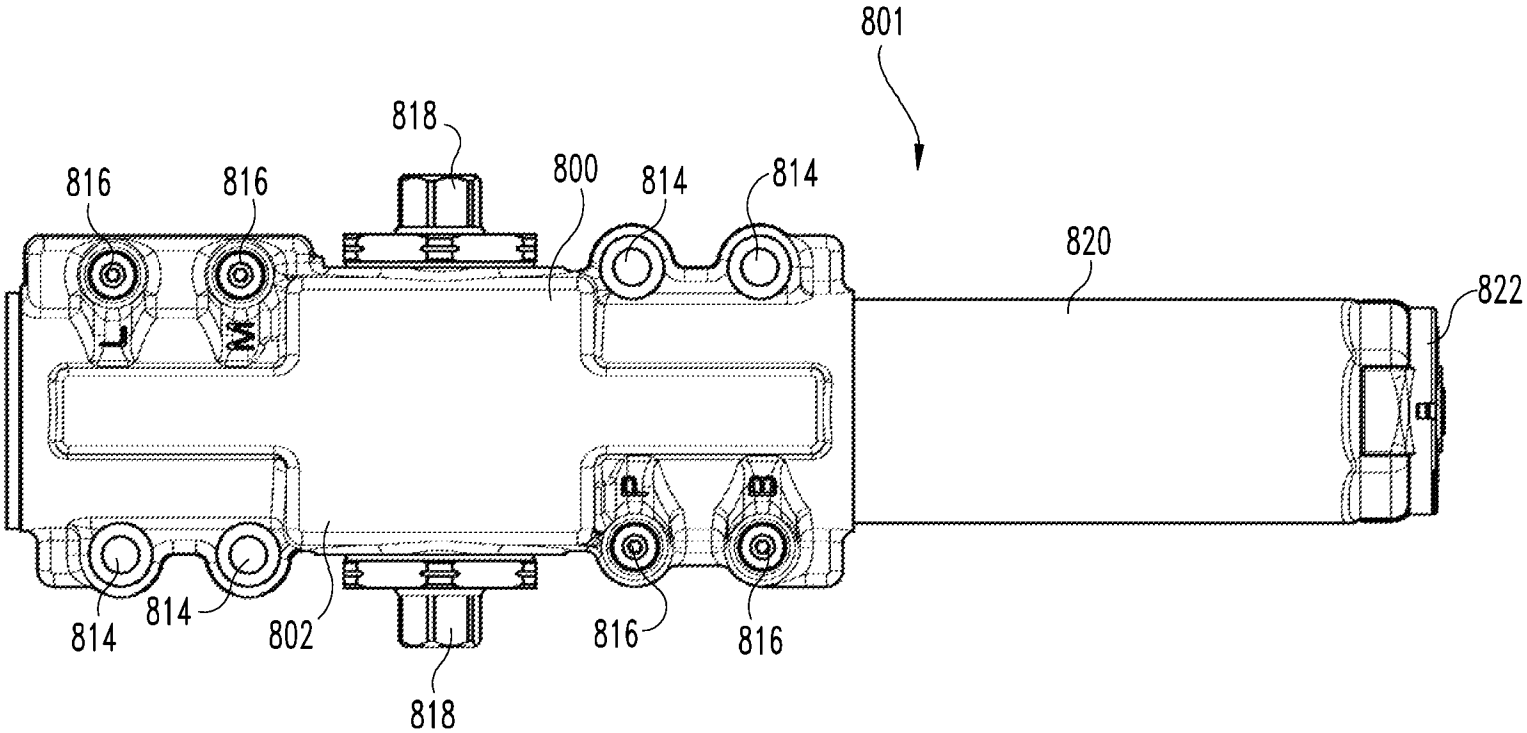
FIG. 8G is a front plan view of a closer body including the closer housing of FIGS. 8A-8F with a spring tube assembled therewith.

Referring now to FIGS. 8A-8G, illustrated therein is a closer body 801 according to certain embodiments. The closer body 801 includes a housing 800 having a spring tube 820 (FIG. 8G) assembled therewith. The housing 800 has a top 810 (FIG. 8A), a front 802 (FIG. 8B), a bottom 812 (FIG. 8C), a left side 806 (FIG. 8D), a right side 808 (FIG. 8E), and a back 804 (FIG. 8F). The closer body 801 includes one or more attachment apertures 814, and in the disclosed embodiment includes four attachment apertures 814 configured to receive fasteners for connecting the closer body 800 to a movable structure such as a door, or a static structure such as a wall or the like. At least one valve mechanism 816 is operably connected to the closer body 801. The valve mechanisms 816 can be one of any of the valve mechanisms previously disclosed herein. In some forms, one or more of the adjustment screws may be replaced with an accessibility selector or a removable plug or the like.

In the illustrated embodiment, the closer body 801 includes four valve mechanisms 816 positioned on the front 802 of the closer body 801 with no valve mechanisms 816 positioned on the back 804 of the closer body 801. In other forms, the closer body 801 can include a different number of adjustment screws extending from the front 802 or the back 804 thereof. The closer body 801 may further include at least one packing nut 818 configured to hold a bearing assembly and pinion in a desired location during shipping of the closer body 801. A spring tube 820 can be operably assembled with the housing 800 so as to provide a closing force to the door. A spring force within the spring tube 820 can be adjusted by way of a spring power adjustor 822 positioned on a distal end thereof.

Figure 9A:
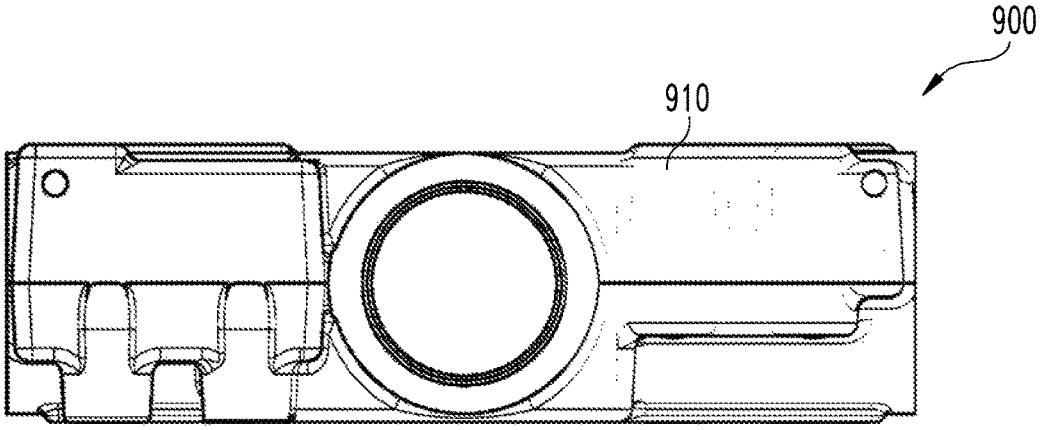
FIGS. 9A-9F respectively show a top view, front view, bottom view, left side view, right side view, and back view of a closer housing according to certain embodiments.
Figure 9B:
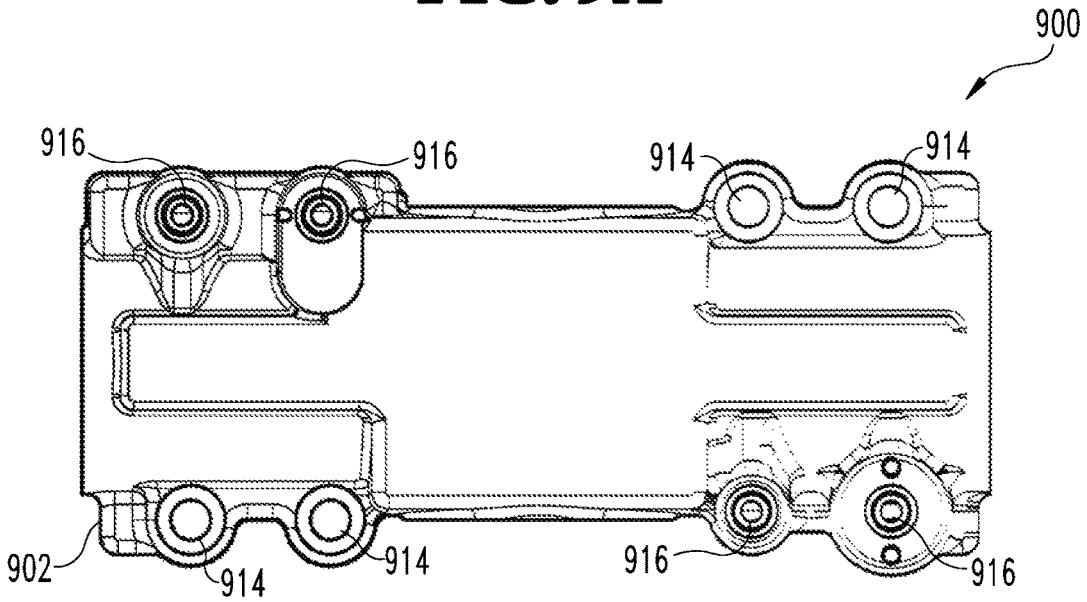
Figure 9C:
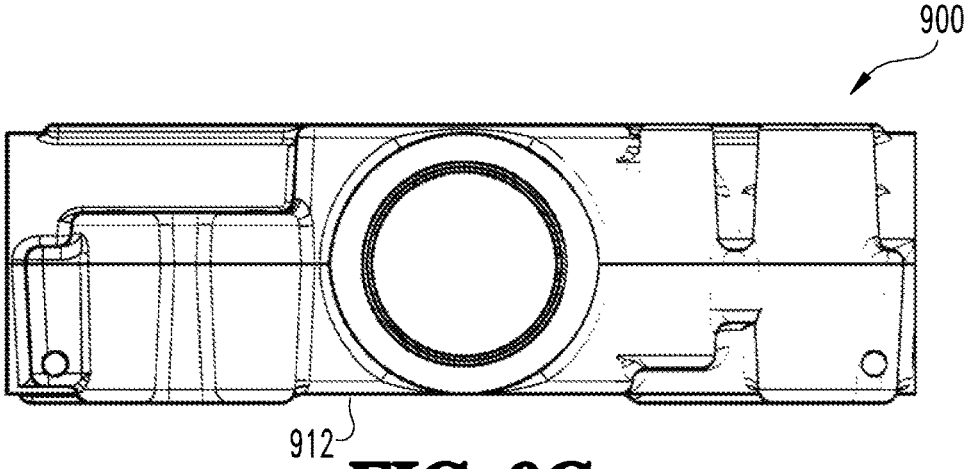
Figure 9D:
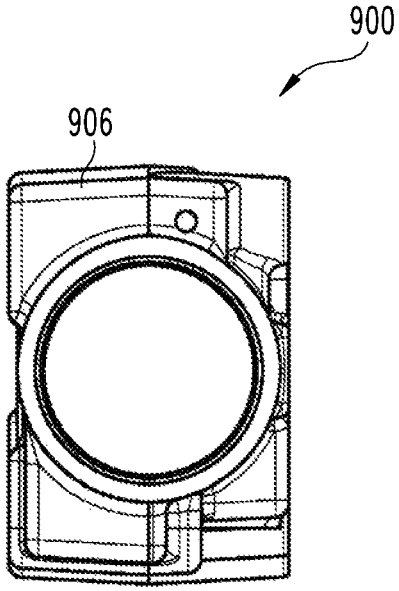
Figure 9E:
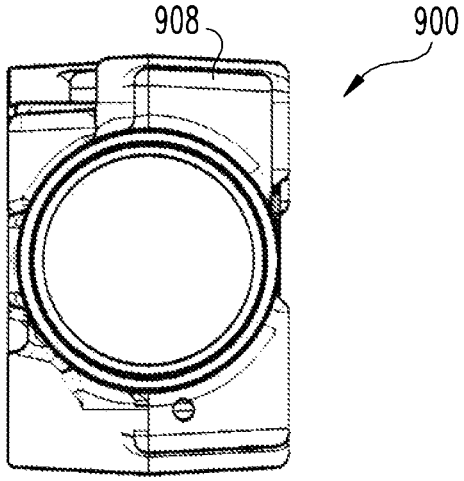
Figure 9F:
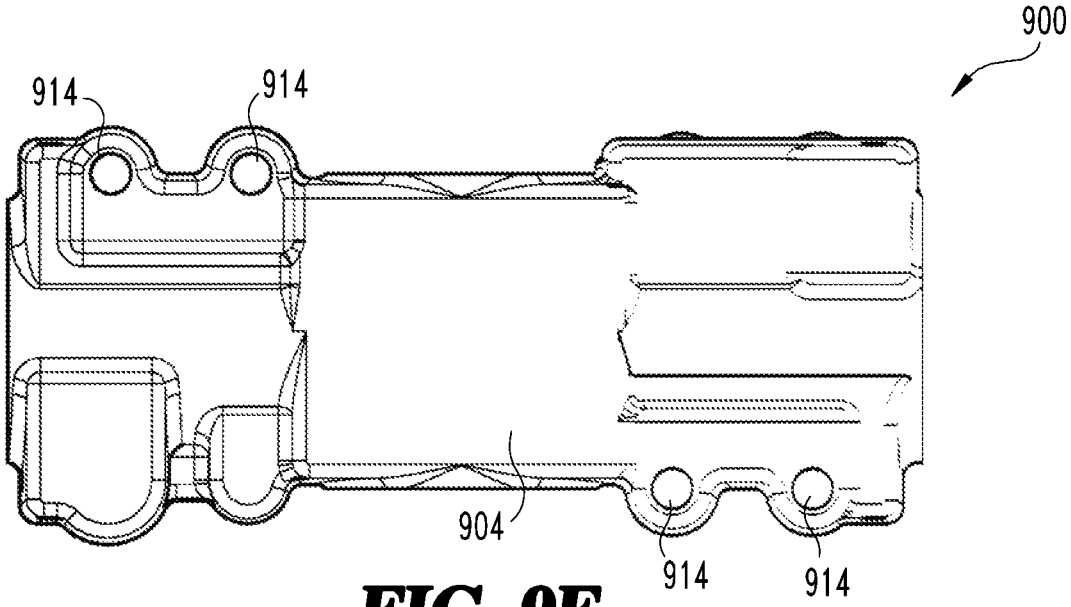
Figure 9G:
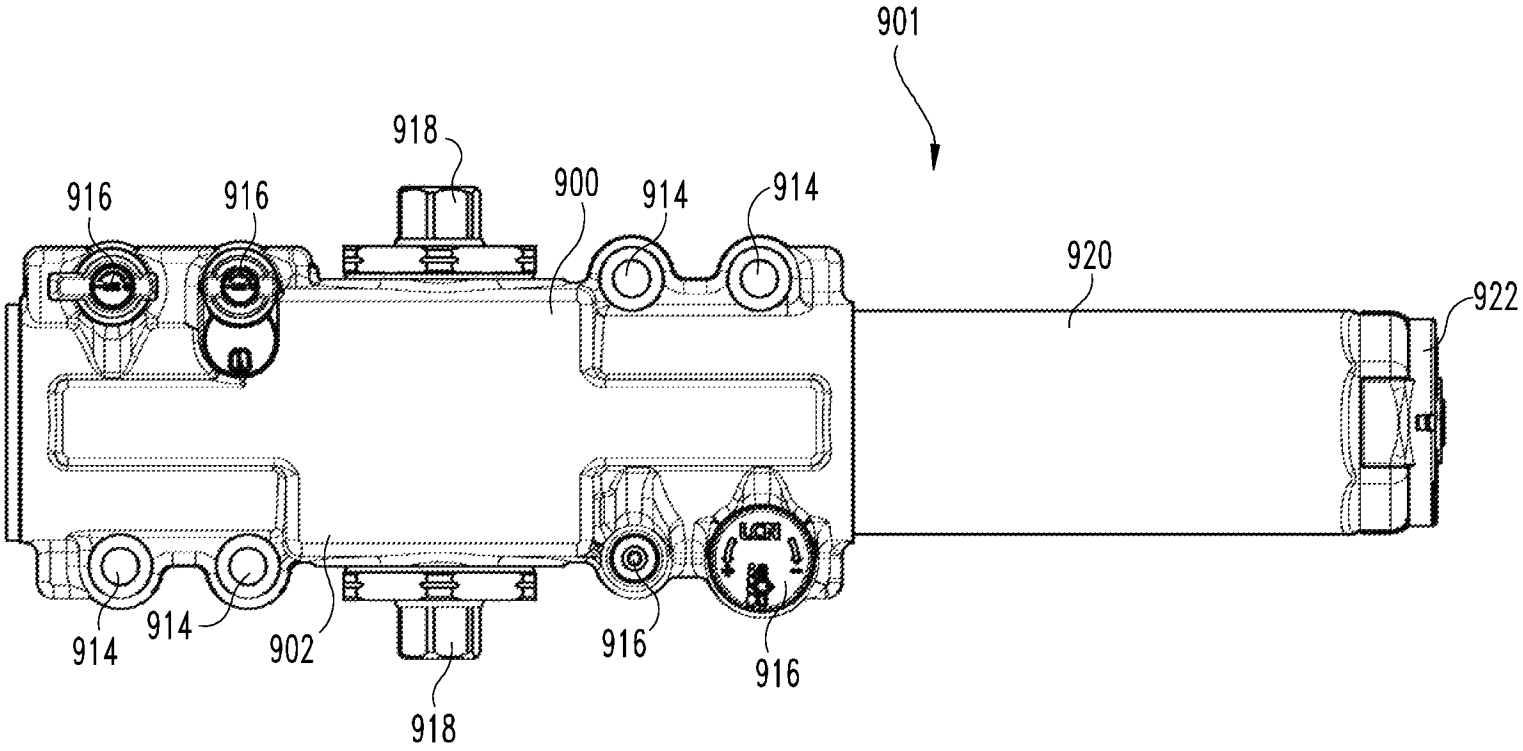
FIG. 9G is a front plan view of a closer body including the closer housing of FIGS. 9A-9F with a spring tube assembled therewith.

Referring now to FIGS. 9A-9G, illustrated therein is a closer body 901 according to certain embodiments. The closer body 901 includes a housing 900 having a spring tube 920 (FIG. 9G) assembled therewith. The housing 900 has a top 910 (FIG. 9A), a front 902 (FIG. 9B), a bottom 912 (FIG. 9C), a left side 906 (FIG. 9D), a right side 908 (FIG. 9E), and a back 904 (FIG. 9F). The closer body 901 includes one or more attachment apertures 914, and in the disclosed embodiment includes four attachment apertures 914 configured to receive fasteners for connecting the closer body 901 to a movable structure such as a door or a static structure such as a wall or the like. At least one valve mechanism 916 is operably connected to the closer body 901. The valve mechanism 916 can be one of any of the valve mechanisms previously disclosed herein. In some forms, one or more of the adjustment screws may be replaced with an accessibility selector or a removable plug or the like.

In the illustrated embodiment, the closer body 901 includes four valve mechanisms 916 positioned on the front 902 of the closer body 901 with no adjustment screws 916 positioned on the back 904 of the closer body 901. In other forms, the closer body 901 can include a different number of valve mechanisms extending from the front 902 or the back 904 thereof. The closer body 901 may further include at least one packing nut 918 configured to hold a bearing assembly and pinion in a desired location therein. A spring tube 920 can be operably assembled with the housing 900 so as to provide a closing force to the door. A spring force within the spring tube 920 can be adjusted by way of a spring power adjustor 922 positioned on a distal end thereof.

Figure 10A:
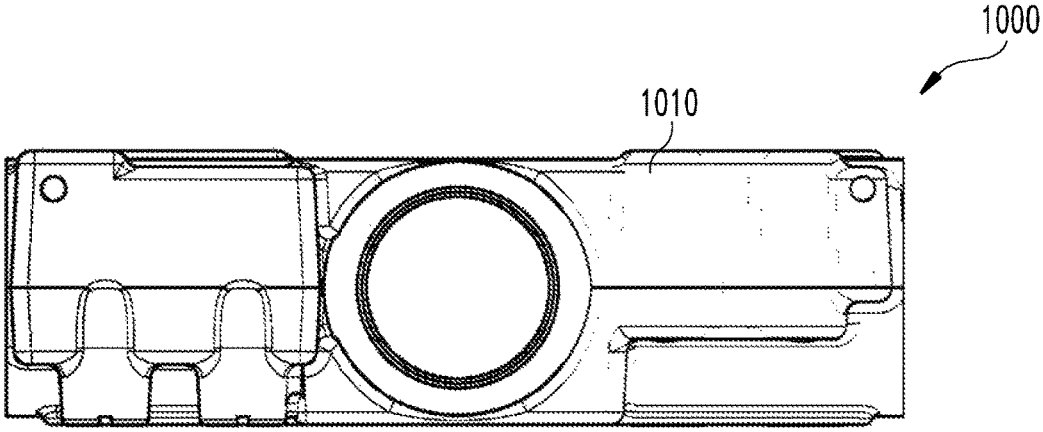
FIGS. 10A-10F respectively show a top view, front view, bottom view, left side view, right side view, and back view of a closer housing according to certain embodiments.
Figure 10B:
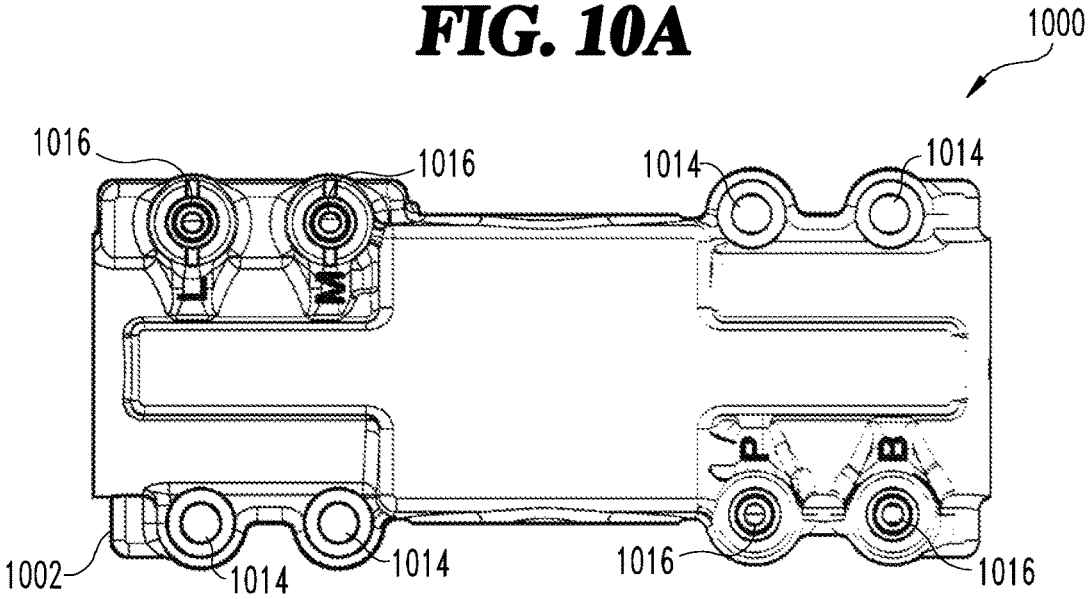
Figure 10C:
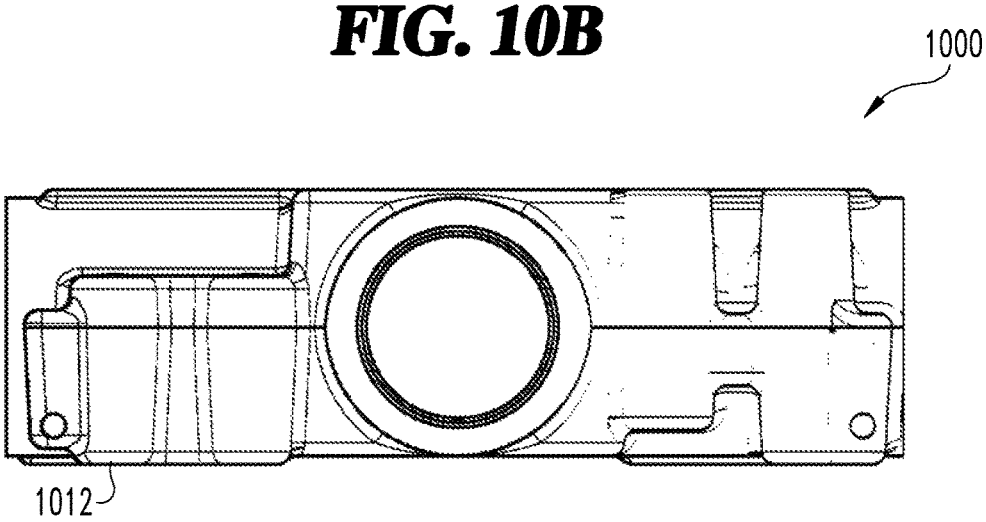
Figure 10D:
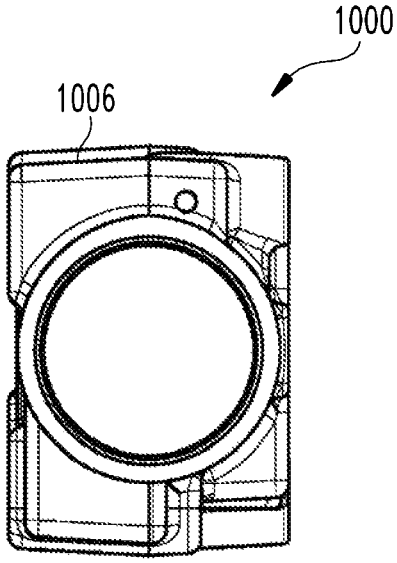
Figure 10E:
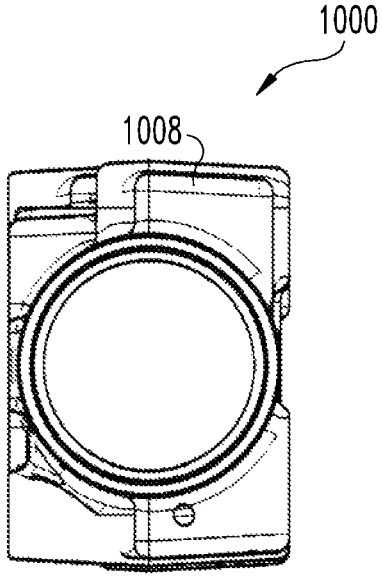
Figure 10F:
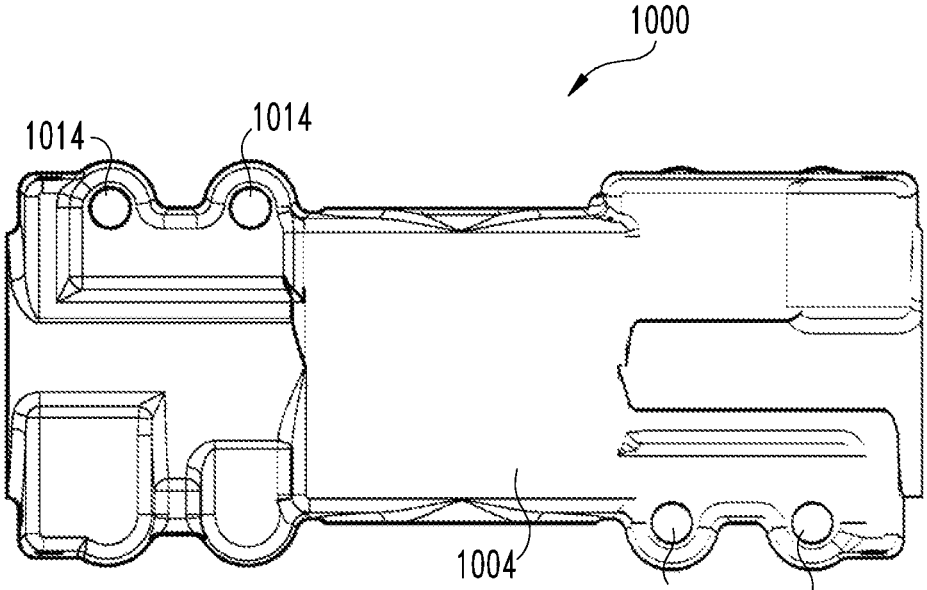
Figure 10G:
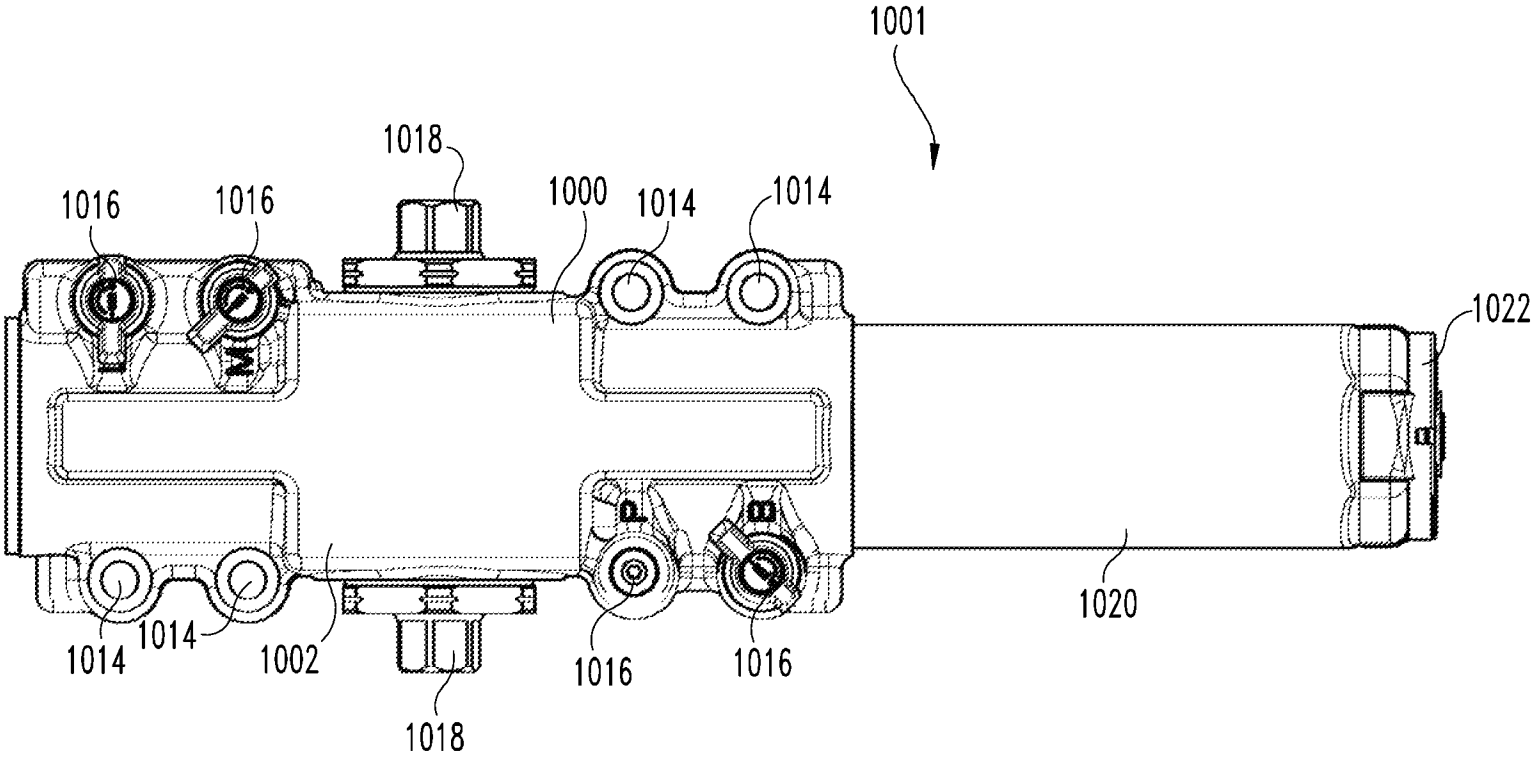
FIG. 10G is a front plan view of a closer body including the closer housing of FIGS. 10A-10F with a spring tube assembled therewith.

Referring now to FIGS. 10A-10G, illustrated therein is a closer body 1001 according to certain embodiments. The closer body 1001 includes a housing 1000 having a spring tube 1020 (FIG. 10G) assembled therewith. The housing 1000 has a top 1010 (FIG. 10A), a front 1002 (FIG. 10B), a bottom 1012 (FIG. 10C), a left side 1006 (FIG. 10D), a right side 1008 (FIG. 10E), and a back 1004 (FIG. 10F). The closer body 1001 includes one or more attachment apertures 1014, and in the disclosed embodiment includes four attachment apertures 1014 configured to receive fasteners for connecting the closer body 1000 to a movable structure such as a door or a static structure such as a wall or the like. At least one valve mechanism 1016 is operably connected to the closer body 1000. The valve mechanisms 1016 can be one of any of the valve mechanisms previously disclosed herein. In some forms the one or more of the adjustment screws may be replaced with an accessibility selector or a removable plug or the like.

In the illustrated embodiment, the closer body 1001 includes four valve mechanisms 1016 positioned on the front 1002 of the closer body 1001 with no valve mechanisms 1016 positioned on the back 1004 of the closer body 1001. In other forms, the closer body 1001 can include a different number of valve mechanisms positioned on the front 1002 or the back 1004 thereof. The closer body 1001 may further include at least one packing nut 1018 configured to hold a bearing assembly and pinion in a desired location therein. A spring tube 1020 can be operably assembled with the housing 1000 so as to provide a closing force to the door. A spring force within the spring tube 1020 can be adjusted by way of a spring power adjustor 1022 positioned on a distal end thereof.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore, it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A door closer comprising:

a closer body having a working fluid disposed therein, the closer body defining a passageway;

a piston slidably mounted in the closer body for movement between a first position and a second position, the piston defining a rack;

a pinion gear engaged with the rack of the piston;

a valve mechanism mounted to the closer body and configured to control a flow rate of working fluid passing through the passageway as the piston moves between the first position and the second position, the valve mechanism comprising an adjustment screw and a manual actuator operable to rotate the adjustment screw; and a feedback mechanism including an indicator configured to indicate a position of the valve mechanism and/or movement of the valve mechanism; and wherein the feedback mechanism is defined at least in part by the manual actuator.

2. The door closer of claim 1, wherein the manual actuator comprises a control knob, and wherein the feedback mechanism comprises a visual indicator.

3. The door closer of claim 2, wherein the visual indicator includes an arrow indicating a direction in which to rotate the control knob to increase or decrease the flow rate of working fluid.

4. The door closer of claim 2, wherein the visual indicator includes first and second lever arms having different sizes, and wherein the first and second lever arms are positioned on the control knob.

5. The door closer of claim 2, wherein the visual indicator includes a symbol indicating a position of the adjustment screw.

6. The door closer of claim 2, wherein the visual indicator includes an indicator pin extending into a slot in the control knob, the indicator pin being movable between a plurality of positions to indicate a position of the adjustment screw.

7. The door closer of claim 6, further comprising:

a knob seat positioned between the control knob and the closer body, wherein a first side of the knob seat faces the control knob and includes a spiral groove, and wherein an opposite second side of the knob seat includes an anti-rotation feature engaged with the closer body; and wherein the indicator pin is engaged with the spiral groove of the knob seat such that the indicator pin changes position within the slot as the control knob is rotated.

8. The door closer of claim 1, wherein the manual actuator comprises a control knob, and wherein the feedback mechanism is configured to transmit discrete torque resisting forces and to generate an audible sound during rotation of the control knob.

9. The door closer of claim 8, further comprising:

a sleeve positioned between the control knob and the housing;

a plurality of serration teeth projecting inward from the sleeve; and at least one engagement tooth projecting outward from the control knob; and wherein the at least one engagement tooth engages the serration teeth of the sleeve as the control knob is rotated.

10. The door closer of claim 1, wherein the feedback mechanism includes:

a case positioned between the manual actuator and the closer body;

a rotatable indicator gear positioned within the case, the rotatable indicator gear including indicia and a plurality of teeth;

a window formed in the case to display one of the indicia on the indicator gear; and a plurality of drive teeth projecting from the manual actuator and configured to engage with the plurality of teeth of the rotatable indicator; and wherein the indicia displayed in the window changes as the manual actuator is rotated.

11. A valve mechanism for a door closer, the valve mechanism comprising:

a valve body configured to be positioned within a bore of a closer body, the valve body including threads configured to linearly move the valve body between a closed position and an open position in response to rotation of the valve body, wherein the valve body includes a drive coupling and a seal region;

a control knob operably connected with the drive coupling such that rotation of the control knob causes a corresponding rotation of the valve body;

at least one leg extending from the control knob with an outwardly projecting lip, the outwardly projecting lip configured to rotatably couple the control knob to the closer body; and an indicator configured to provide feedback that varies with rotation of the control knob, wherein the feedback comprises at least one of visual feedback, tactile feedback, and audible feedback.

12. The valve mechanism of claim 11, wherein the control knob includes a drive coupling receiver including a slot configured to transmit torque and permit axial sliding movement of the drive coupling during rotation of the control knob.

13. The valve mechanism of claim 11, wherein the control knob includes at least two lever arms that are different in size and/or shape, and wherein the indicator comprises the at least two lever arms.

14. The valve mechanism of claim 11, wherein the indicator includes:

a sleeve positioned between the control knob and the closer body, the sleeve having a plurality of serration teeth projecting inwardly; and at least one engagement tooth projecting outwardly from the control knob; and wherein the engagement tooth engages with the serration teeth as the control knob is rotated to generate a variable rotational resistance and an audible sound.

15. The valve mechanism of claim 11, wherein the indicator includes:

a case positioned between the control knob and a housing;

a rotatable indicator gear positioned within the case, the rotatable indicator gear having alpha-numeric markings and a plurality of teeth;

a window formed in the case to display one of the plurality of alpha-numeric markings on the indicator gear; and a plurality of drive teeth projecting outward from the control knob to engage with the teeth of the rotatable indicator gear; and wherein the alpha-numeric marking displayed in the window changes as the control knob is rotated.

16. The valve mechanism of claim 11, further comprising:

a drive shaft connected between the drive coupling of the valve body and a drive coupling receiver of the control knob;

a knob seat positioned between the control knob and a housing, the knob seat comprising a spiral groove and an anti-rotation feature; and an indicator pin extending between the spiral groove and a slot formed in the control knob; and wherein the position of the indicator pin changes as the control knob is rotated to indicate a position of the valve body.

17. The valve mechanism of claim 16, wherein the indicator pin is movable between first and second positions within the slot while moving along the spiral groove.

18. The valve mechanism of claim 16, wherein the at least one leg includes a clip arm extending from the control knob to engage with a spiral groove formed in the knob seat.

19. The valve mechanism of claim 16, wherein the knob seat includes a seat leg having a lip extending therefrom and configured to connect to a groove formed in the housing.

20. A door closer, comprising:

a closer body defining a chamber having a working fluid disposed therein;

a piston mounted for reciprocal movement in the closer body, the piston defining a rack;

a pinion rotatably mounted to the closer body, the pinion engaged with the rack such that the reciprocal movement of the piston is correlated with rotation of the pinion;

a passageway defined in the closer body, wherein the working fluid flows through the passageway during the reciprocal movement of the piston such that a rate of fluid flow through the passageway is correlated with a movement speed of the piston;

a valve mechanism extending into the passageway, the valve mechanism including an adjustment screw operable to adjust a position of a valve body within the passageway, and a manual actuator facilitating manual rotation of the adjustment screw; and feedback means for indicating at least one of (i) a position of the valve mechanism and (ii) movement of the valve mechanism.

21. The door closer of claim 20, wherein the feedback means is defined at least in part by the manual actuator.

22. The door closer of claim 20, wherein the feedback means is configured to provide tactile feedback during movement of the valve body.

23. The door closer of claim 21, wherein the feedback means includes a plurality of serration teeth and at least one engagement tooth engaged with the plurality of serration teeth; and wherein the at least one engagement tooth is configured to travel along the plurality of serration teeth during rotation of the manual actuator to thereby generate discrete audible feedback as the at least one engagement tooth travels along the plurality of serration teeth.

24. The door closer of claim 20, wherein the feedback means is configured to provide visual feedback related to a position of the valve mechanism.

25. The door closer of claim 24, wherein the feedback means comprises:

a slot formed in the manual actuator;

a seat positioned behind the manual actuator, the seat comprising a spiral groove; and an indicator pin seated in the slot and the spiral groove such that rotation of the manual actuator relative to the seat causes movement of the indicator pin along the spiral groove and the slot.

* * * * *